US006717504B2

(12) United States Patent
Fujiwara et al.

(10) Patent No.: US 6,717,504 B2
(45) Date of Patent: Apr. 6, 2004

(54) MAGNETIC CORE INCLUDING BIAS MAGNET AND INDUCTOR COMPONENT USING THE SAME

(75) Inventors: Teruhiko Fujiwara, Sendai (JP); Masayoshi Ishii, Sendai (JP); Haruki Hoshi, Sendai (JP); Keita Isogai, Sendai (JP); Toru Ito, Miyagi (JP); Tamiko Ambo, Tokyo (JP)

(73) Assignee: NEC Tokin Corporation, Sendai (JP)

( * ) Notice: Subject to any disclaimer, the term of this patent is extended or adjusted under 35 U.S.C. 154(b) by 2 days.

(21) Appl. No.: 10/039,893

(22) Filed: Oct. 24, 2001

(65) Prior Publication Data

US 2002/0097127 A1 Jul. 25, 2002

(30) Foreign Application Priority Data

Oct. 25, 2000 (JP) ..... 2000/325859
Jan. 31, 2001 (JP) ..... 2001/023120
Apr. 17, 2001 (JP) ..... 2001/117665

(51) Int. Cl.[7] ..... H01F 27/24

(52) U.S. Cl. ..... 336/233; 336/178

(58) Field of Search ..... 336/65, 83, 110, 336/211–213, 214–217, 178, 233, 234; 148/300, 312, 314

(56) References Cited

FOREIGN PATENT DOCUMENTS

JP 50-133453 10/1975

*Primary Examiner*—Tuyen T. Nguyen
(74) *Attorney, Agent, or Firm*—Frishauf, Holtz, Goodman & Chick, P.C.

(57) ABSTRACT

A low-profile magnetic core capable of reducing the thickness of an inductor component is provided. The magnetic core includes at least one gap in a magnetic path, and a permanent magnet is inserted in the gap. The magnetic core has an alternating current magnetic permeability at 20 kHz of 45 or more in a magnetic field of 120 Oe under application of direct current, and has a core loss characteristic of 100 kW/m$^3$ or less under the conditions of 20 kHz and the maximum magnetic flux density of 0.1 T. An inductor component is produced by applying at least one turn of coil to the aforementioned magnetic core.

28 Claims, 29 Drawing Sheets

MAGNETIC CORE INCLUDING BIAS MAGNET AND INDUCTOR COMPONENT USING THE SAME

BACKGROUND OF THE INVENTION

1. Field of the Invention

The present invention relates to a permanent magnet for magnetic bias used for a magnetic core (hereafter, may be briefly referred to as "core") of an inductor component, for example, choke coils and transformers. In particular, the present invention relates to a magnetic core, that is, a low-profile magnetic core capable of reducing the thickness of the inductor component.

2. Description of the Related Art

Regarding conventional choke coils and transformers used for, for example, switching power supplies, usually, the alternating current is applied by superimposing on the direct current. Therefore, the magnetic cores used for these choke coils and transformers have been required to have an excellent magnetic permeability characteristic, that is, magnetic saturation with this direct current superimposition does not occur (this characteristic is referred to as "direct current superimposition characteristic").

As high-frequency magnetic cores, ferrite magnetic cores and dust cores have been used. However, the ferrite magnetic core has a high initial permeability and a small saturation magnetic flux density, and the dust core has a low initial permeability and a high saturation magnetic flux density. These characteristics are derived from material properties. Therefore, in many cases, the dust cores are used in a toroidal shape. On the other hand, regarding the ferrite magnetic cores, the magnetic saturation with direct current superimposition has been avoided, for example, by forming a magnetic gap in a central leg of an E type core.

However, since miniaturization of electronic components is required accompanying recent request for miniaturization of electronic equipment, magnetic gaps of the magnetic cores must become small, and requirements for magnetic cores having a high magnetic permeability for the direct current superimposition have become intensified.

In general, in order to meet this requirement, magnetic cores having a high saturation magnetization must be chosen, that is, the magnetic cores not causing magnetic saturation in high magnetic fields must be chosen. However, since the saturation magnetization is inevitably determined from a composition of a material, the saturation magnetization cannot be increased infinitely.

A conventionally suggested method for overcoming the aforementioned problem was to cancel the direct current magnetic field due to the direct current superimposition by incorporating a permanent magnet in a magnetic gap formed in a magnetic path of a magnetic core, that is, to apply the magnetic bias to the magnetic core.

This magnetic bias method using the permanent magnet was superior method for improving the direct current superimposition characteristic. However, since when a metal-sintered magnet was used, an increase of core loss of the magnetic core was remarkable, and when a ferrite magnet was used, the superimposition characteristic did not be stabilized, this method could not be put in practical use.

As a method for overcoming the aforementioned problems, for example, Japanese Unexamined Patent Application Publication No. 50-133453 discloses that a rare-earth magnet powder having a high coercive force and a binder were mixed and compression molded or compacted to produce a bonded magnet, the resulting bonded magnet was used as a permanent magnet for magnetic bias and, therefore, the direct current superimposition characteristic and an increase in the core temperature were improved.

However, in recent years, requirements for the improvement of power conversion efficiency of the power supply have become even more intensified, and regarding the magnetic cores for choke coils and transformers, superiority or inferiority cannot be determined based on only the measurement of the core temperature. Therefore, evaluation of measurement results using a core loss measurement apparatus is indispensable. As a matter of fact, the inventors of the present invention conducted the research with the result that even when the resistivity was a value indicated in Japanese Unexamined Patent Application Publication No. 50-133453, degradation of the core loss characteristic occurred.

Furthermore, since miniaturization of inductor components has been even more required accompanying recent miniaturization of electronic components, requirements for low-profile magnet for magnet bias have also become intensified.

In recent years, surface-mounting type coils have been required. The coil is subjected to a reflow soldering treatment in order to surface-mount. Therefore, the magnetic core of the coil is required to have characteristics not being degraded under this condition. In addition, a rare-earth magnet having oxidation resistance is indispensable.

SUMMARY OF THE INVENTION

Accordingly, it is an object of the present invention to provide a magnetic core using a magnet for magnetic bias especially having a capability to miniaturize the magnetic core. The magnetic core has at least one gap in a magnetic path of a miniaturized inductor component, and has a permanent magnet as a magnet for magnetic bias in the neighborhood of the gap in order to apply magnetic bias to the magnetic core from both ends of the gap.

It is another object of the present invention to provide a magnetic core having superior direct current superimposition characteristic and core loss characteristic, with ease at low cost. Furthermore, the magnetic core has oxidation resistance and, therefore, the characteristics are not affected even under the reflow conditions.

It is still another object of the present invention to provide, in consideration of the above description, a magnetic core having superior direct current superimposition characteristic and core loss characteristic with ease at low cost regarding the magnetic core having at least one gap in a magnetic path, and having a permanent magnet as a magnet for magnetic bias in the neighborhood of the gap in order to apply magnetic bias to the magnetic core from both ends of the gap.

It is yet another object of the present invention to provide a miniaturized inductor component.

According to an aspect of the present invention, there is provided a magnetic core which includes at least one gap in a magnetic path and a permanent magnet inserted into the gap, has an alternating current magnetic permeability at 20 kHz of 45 or more in a magnetic field of 120 Oe under application of direct current, and has a core loss characteristic of 100 $kW/m^3$ or less under the conditions of 20 kHz and the maximum magnetic flux density of 0.1 T.

According to another aspect of the present invention, there is provided an inductor component which includes the aforementioned magnetic core, and at least one turn of coil is applied to the magnet core.

DESCRIPTION OF THE PREFERRED EMBODIMENTS

Figure 1A:
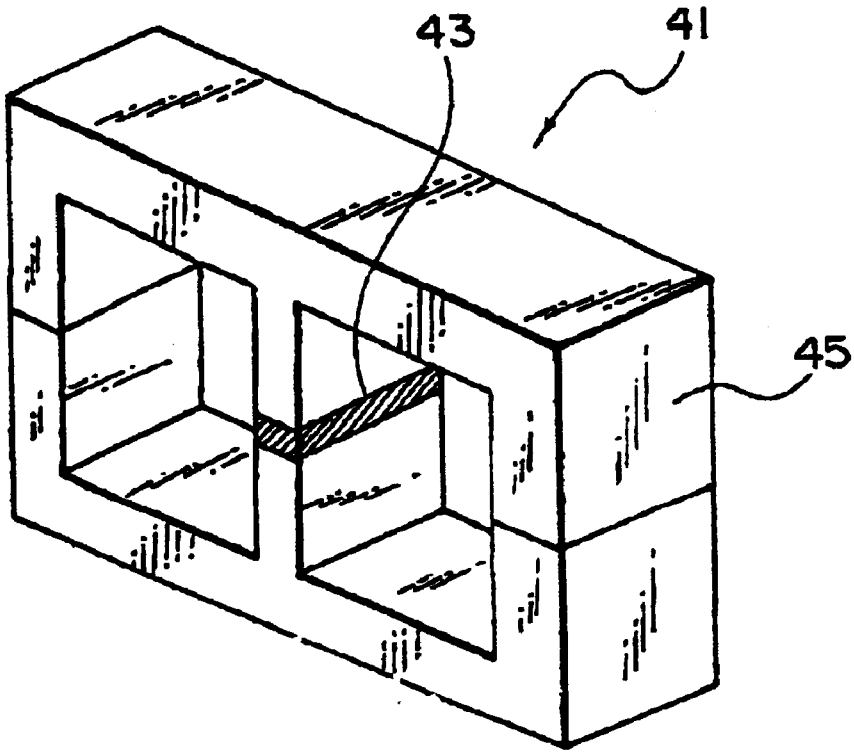
FIG. 1A is a schematic perspective view of an EE type Mn—Zn ferrite magnetic core according to Examples 1 to 3.

The present invention will now be further specifically described.

A magnetic core according to the present invention includes at least one gap in a magnetic path, and a permanent magnet inserted in the gap, and has an alternating current magnetic permeability at 20 kHz of 45 or more in a magnetic field of 120 Oe under application of direct current, and a core loss characteristic of 100 kW/m$^3$ or less under the conditions of 20 kHz and the maximum magnetic flux density of 0.1 T.

Preferably, the magnetic core is made of Ni—Zn ferrite or Mn—Zn ferrite, and the magnet is a bonded magnet composed of a rare-earth magnet powder and binder.

Furthermore, regarding the magnetic core, preferably, the bonded magnet contains the rare-earth magnet powder having an average particle diameter of more than 0 $\mu$m, but 10 $\mu$m or less and 5 to 30 vol % of binder, and has a resistivity of 1 Ω·cm or more and an intrinsic coercive force of 5 kOe or more.

An inductor component according to the present invention is configured by applying at least one turn of coil to the aforementioned magnetic core.

This is because the magnet characteristic necessary for achieving superior direct current superimposition characteristic is an intrinsic coercive force rather than an energy product and, therefore, even when a permanent magnet having a high resistivity is used, sufficiently high direct current superimposition characteristic can be achieved as long as the intrinsic coercive force is high.

The magnet having a high resistivity and high intrinsic coercive force, can be generally realized by a rare-earth bonded magnet produced by mixing a rare-earth magnet powder and binder and by molding the resulting mixture, although the composition is not specifically limited as long as the magnet powder has a high coercive force. The kind of the rare-earth magnet powder may be any of Sm—Co-base, Nd—Fe—B-base, and Sm—Fe—N-base. However, since the strength of the bias magnetic field is determined depending on the strength of the remanent magnetization of the powder, and the stability of the magnetic characteristics are determined depending on the coercive force, the kind of the magnet powder must be chosen depending on the kind of the magnetic core.

In the present invention, as the material for the magnetic core for choke coil and transformer, Mn—Zn ferrite or Ni—Zn ferrite having a low core loss is used, and the magnetic core includes at least one gap in a magnetic path and a permanent magnet inserted in the gap.

The shape of the magnetic core is not specifically limited and, therefore, the present invention can be applied to magnetic cores having any shape, for example, toroidal magnetic cores, EE type magnetic cores, and EI type magnetic cores. The gap length is not specifically limited, although when the gap length is excessively reduced, the direct current superimposition characteristic is degraded, and when the gap length is excessively increased, the magnetic permeability is excessively reduced and, therefore, the gap length to be formed is inevitably determined.

Regarding the characteristics required of the permanent magnet to be inserted into the gap, when the intrinsic coercive force is less than 5 kOe, magnetization disappears due to a direct current magnetic field applied to the magnetic core and, therefore, a coercive force equivalent to, or more than, 5 kOe is required. The greater resistivity is the better. However, the resistivity does not become a primary factor of degradation of the core loss as long as the resistivity is 1 Ω·cm or more. When the average particle diameter of the powder substantially exceeds 10 $\mu$m, the core loss characteristics are degraded and, therefore, the average particle diameter of the powder is preferably 10 $\mu$m or less.

Next, specific examples according to the present invention will be described.

EXAMPLE 1

In the following Example, each of a Sm—Fe—N bonded magnet and ferrite magnet was inserted into a part of the magnetic path of a Mn—Zn ferrite magnetic core, and the respective direct current superimposition characteristics were measured and comparisons were conducted.

The ferrite magnet core used in the experiment was a EE type magnetic core made of Mn—Zn ferrite material and having a magnetic path length of 7.5 cm and an effective cross-sectional area of 0.74 cm$^2$, and the central leg of the EE type magnetic core was processed to have a gap of 3.0 mm.

A Sm—Fe—N magnet powder (average particle diameter of the powder of about 3 $\mu$m) and a binder (epoxy resin) were mixed and die molding or compacting was carried out without magnetic field and, therefore, a bonded magnet was produced. The amount of the binder was 5 wt % of the total weight. The resulting bonded magnet was processed to have a shape of the cross-section of the central leg of the ferrite magnet core and a height of 3.0 mm.

Figure 1B:
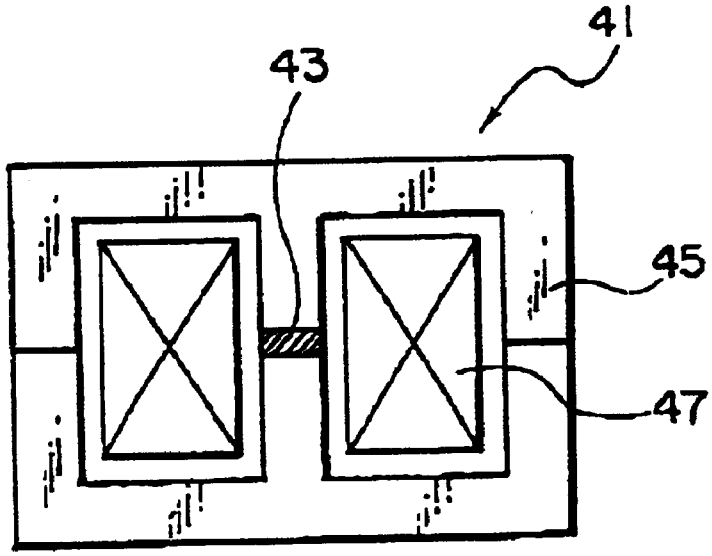
FIG. 1B is a front view of an inductor component shown in FIG. 1A.

The bonded magnet and the ferrite magnet were magnetized with an electromagnet in the direction of the magnetic path, and were inserted into the gap portion so as to produce magnetic cores. Then 120 turns of coil was applied to each of the magnet cores and, therefore, an inductor component was produced. The shapes of these inductor components are shown in FIGS. 1A and 1B. In FIGS. 1A and 1B, reference numeral 43 (diagonally shaded area) denotes a magnet, reference numeral 45 denotes a ferrite magnet core, and reference numeral 47 denotes coiled portions. Regarding the inserted Sm—Fe—N bonded magnet, samples were prepared by changing the strength of the magnetic field used for magnetizing. Each sample had a coercive force and remanent flux density shown in Table 1. The coercive force of the used ferrite magnet was 3 kOe.

TABLE 1

| | coercive force Hc (kOe) | residual flux density Br (G) |
|---|---|---|
| sample 1 | 5 | 950 |
| sample 2 | 11 | 2200 |
| sample 3 | 15 | 3300 |

Regarding each of the magnetic cores with respective magnets being inserted, the direct current superimposition characteristic was measured repeatedly with a 4284A LCR meter manufactured by Hewlet Packerd under the conditions of an alternating current magnetic field frequency of 100 kHz and a superimposed magnetic field of 0 to 200 Oe. At this time, the superimposed current was applied in order to make the direction of the direct current bias magnetic field reverse to the direction of the magnetization of the magnet magnetized during the insertion. The measurement results are shown in FIGS. 2 to 5.

Figure 2:
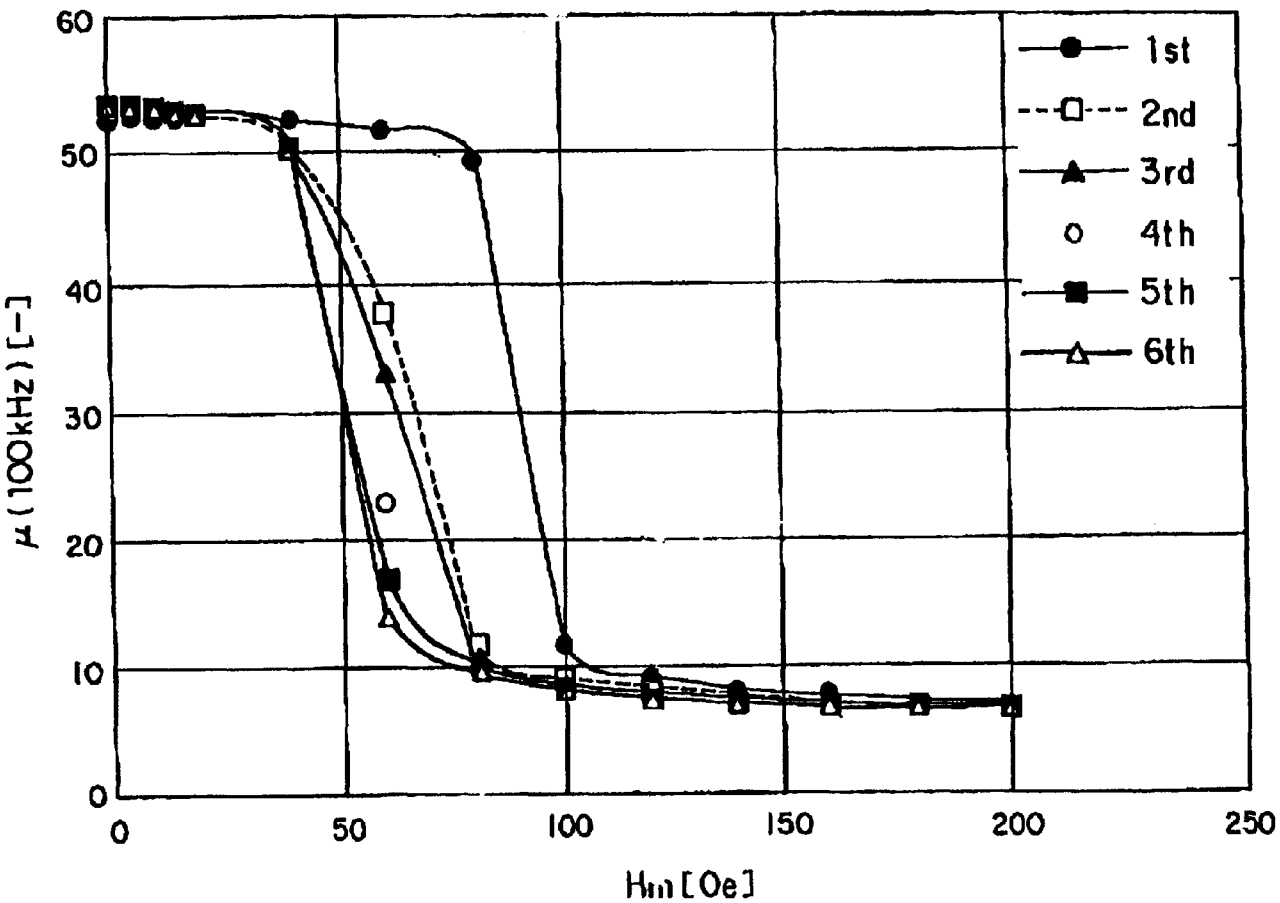
FIG. 2 is a graph showing the results of repeated measurements of direct current superimposition carried out while a ferrite magnet having a coercive force of 3 kOe is inserted into a gap portion of a Mn—Zn ferrite magnetic core in Example 1.
Figure 3:
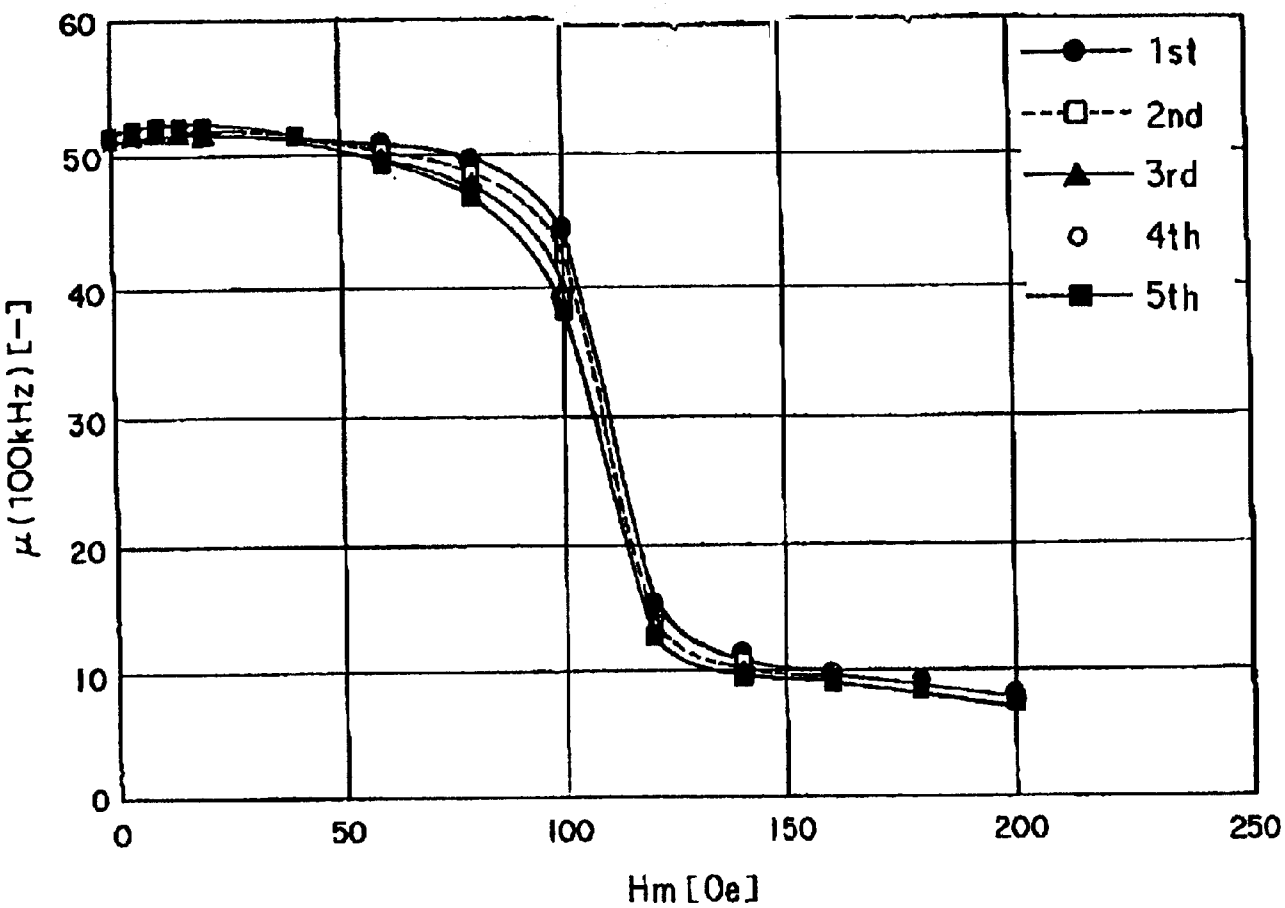
FIG. 3 is a graph showing the results of repeated measurements of direct current superimposition carried out while a Sm—Fe—N bonded magnet having a coercive force of 5 kOe is inserted into a gap portion of a Mn—Zn ferrite magnetic core in Example 1.
Figure 4:
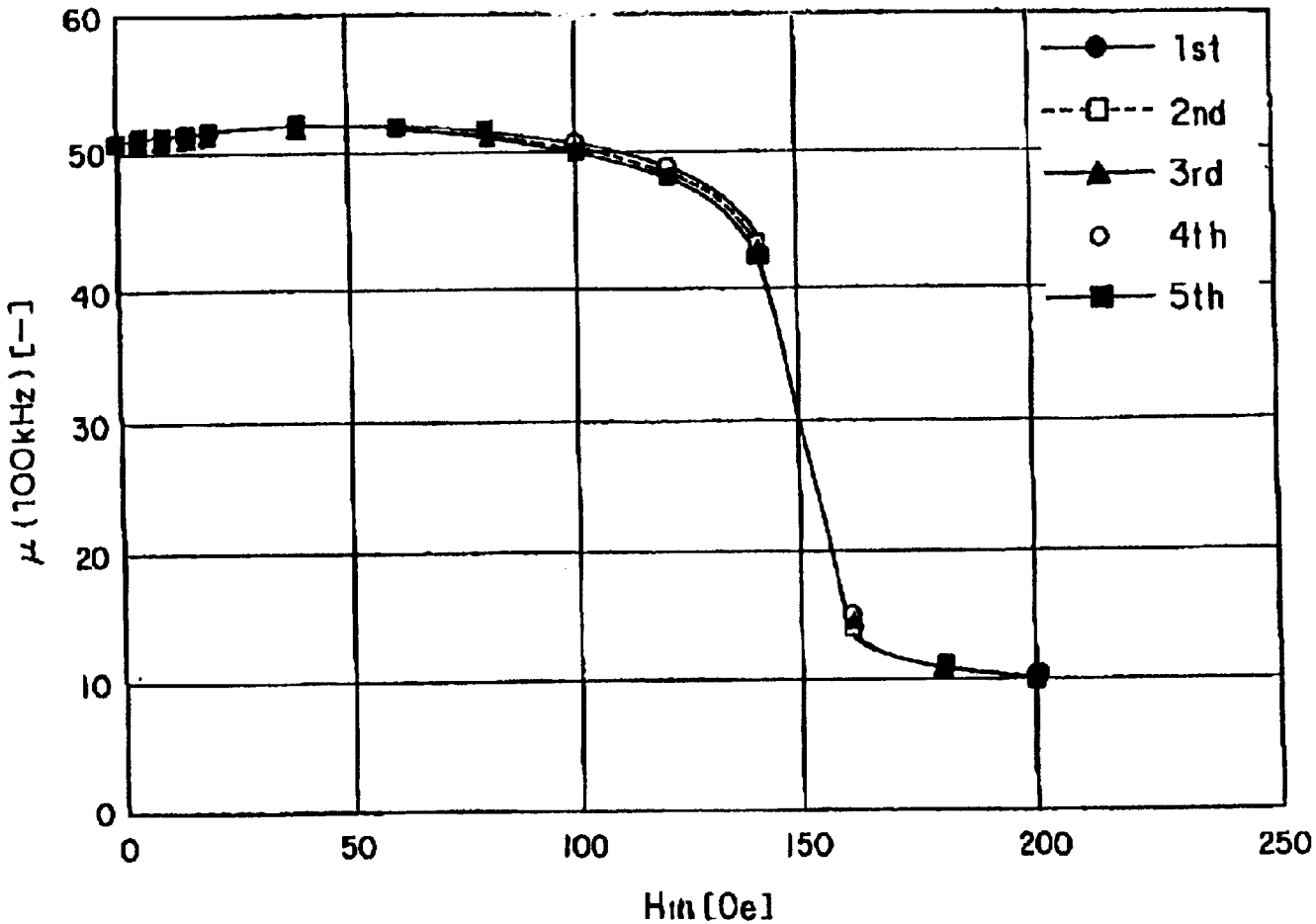
FIG. 4 is a graph showing the results of repeated measurements of direct current superimposition carried out while a Sm—Fe—N bonded magnet having a coercive force of 11 kOe is inserted into a gap portion of a Mn—Zn ferrite magnetic core in Example 1.
Figure 5:
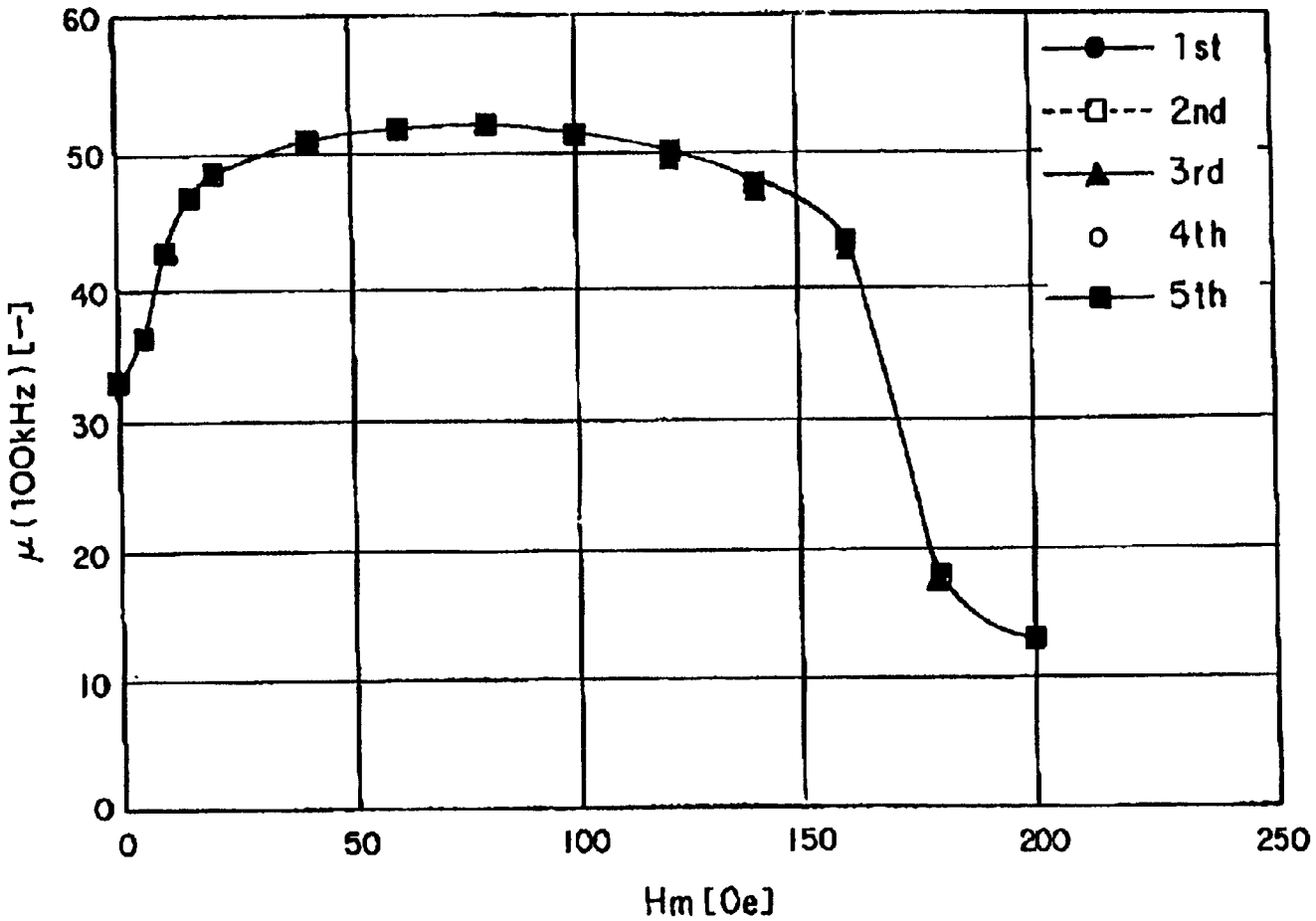
FIG. 5 is a graph showing the results of repeated measurements of direct current superimposition carried out while a Sm—Fe—N bonded magnet having a coercive force of 15 kOe is inserted into a gap portion of a Mn—Zn ferrite magnetic core in Example 1.
Figure 6:
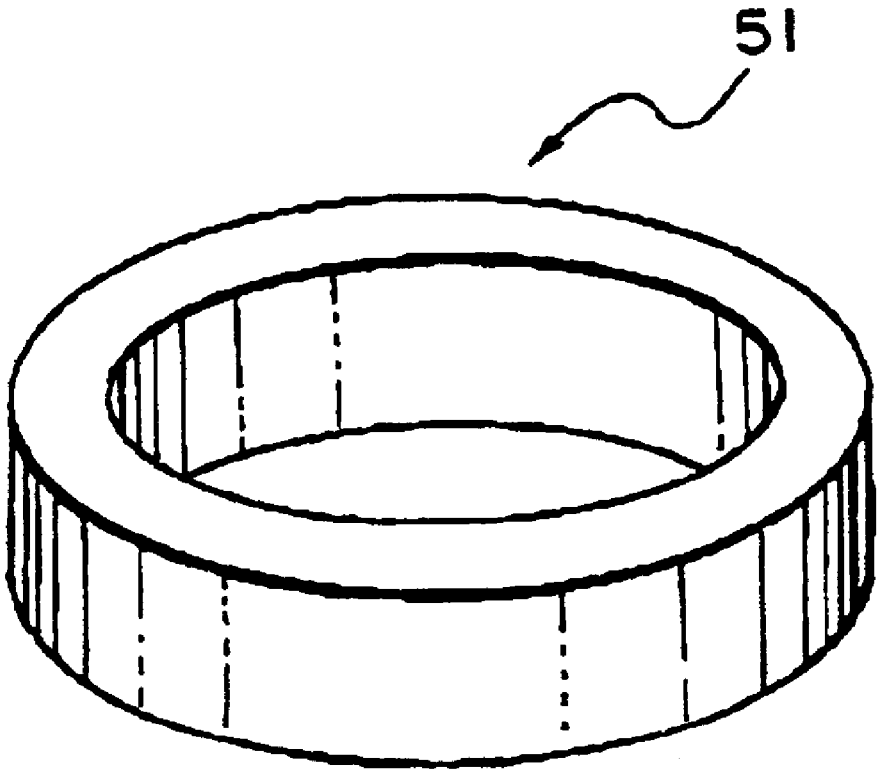
FIG. 6 is a perspective view of a Sendust magnetic core having a toroidal shape in Example 2.

As is clear from FIG. 2, regarding the magnetic core with ferrite magnet having a coercive force of only 3 kOe being inserted, the direct current superimposition characteristic degrades by a large degree with increase in the number of measurements. On the contrary, as is clear from FIGS. 3 to 5, regarding the magnetic core with a Sm—Fe—N bonded magnet having a large coercive force being inserted, no large change is observed in the repeated measurements and, therefore, a very stable characteristic is exhibited.

From these results, the reason for the degradation of the direct current superimposition characteristic can be assumed to be that since the ferrite magnet had a small coercive force, reduction of magnetization or reversion of the miniaturization occurred due to a magnetic field of the reverse direction applied to the magnet. Furthermore, the magnet to be inserted into the magnetic core exhibited superior direct current superimposition characteristic when the magnet was a rare-earth bonded magnet having a coercive force of 5 kOe or more.

EXAMPLE 2

In the following Example, the direct current superimposition characteristics and core losses were measured and comparisons were conducted regarding a Mn—Zn ferrite magnetic core with a magnet being inserted into a part of the magnetic path, a Mn—Zn ferrite magnetic core having the same composition with no magnet being inserted, and a Sendust magnetic core.

The ferrite magnet core used in the experiment was the same with that used in Example 1 and, therefore, was an EE type magnetic core made of Mn—Zn ferrite material and having a magnetic path length of 7.5 cm and an effective cross-sectional area of 0.74 $cm^2$, and the central leg of the EE type magnetic core was processed to have a gap of 3.0 mm. The bonded magnet was magnetized with an electromagnet in the direction of the magnetic path, and was inserted into the gap portion.

Regarding the Sendust magnetic core, a powder having a particle diameter of 150 $\mu$m or less was mixed with a binder (silicone resin), and the resulting mixture was pressed at 20 ton/$cm^2$, and subsequently, was heat-treated at 700° C. for 2 hours so as to produce the Sendust magnetic core. The amount of the binder was 1.5 wt % of the total weight.

Regarding the production of the magnet, a Sm—Fe—N magnet powder (in which average particle diameter of the powder is about 3 $\mu$m) and a binder (of epoxy resin), were mixed and die molding or compacting was carried out without magnetic field. The amount of the binder was 10 wt % of the total weight. The resulting bonded magnet was processed to have a shape of the cross-section of the central leg of the ferrite magnet core and a height of 3.0 mm. The magnet characteristics were measured using a separately prepared test piece having a diameter of 10 and a thickness of 10 with a direct current BH tracer. AS a result, the intrinsic coercive force was 12,500 Oe and remanent flux density was 4,000 G. At the time of the insertion, the direction of the magnetization of the bonded magnet was specified to be reverse to the direction of the direct current bias magnetic field in the measurement of the alternating current magnetic permeability.

The direct current superimposition characteristic was measured with a 4284A LCR meter manufactured by Hewlet Packerd under the conditions of an alternating current magnetic field frequency of 100 kHz and a superimposed magnetic field of 0 to 200 Oe. The results thereof are shown in FIG. 7.

Figure 7:
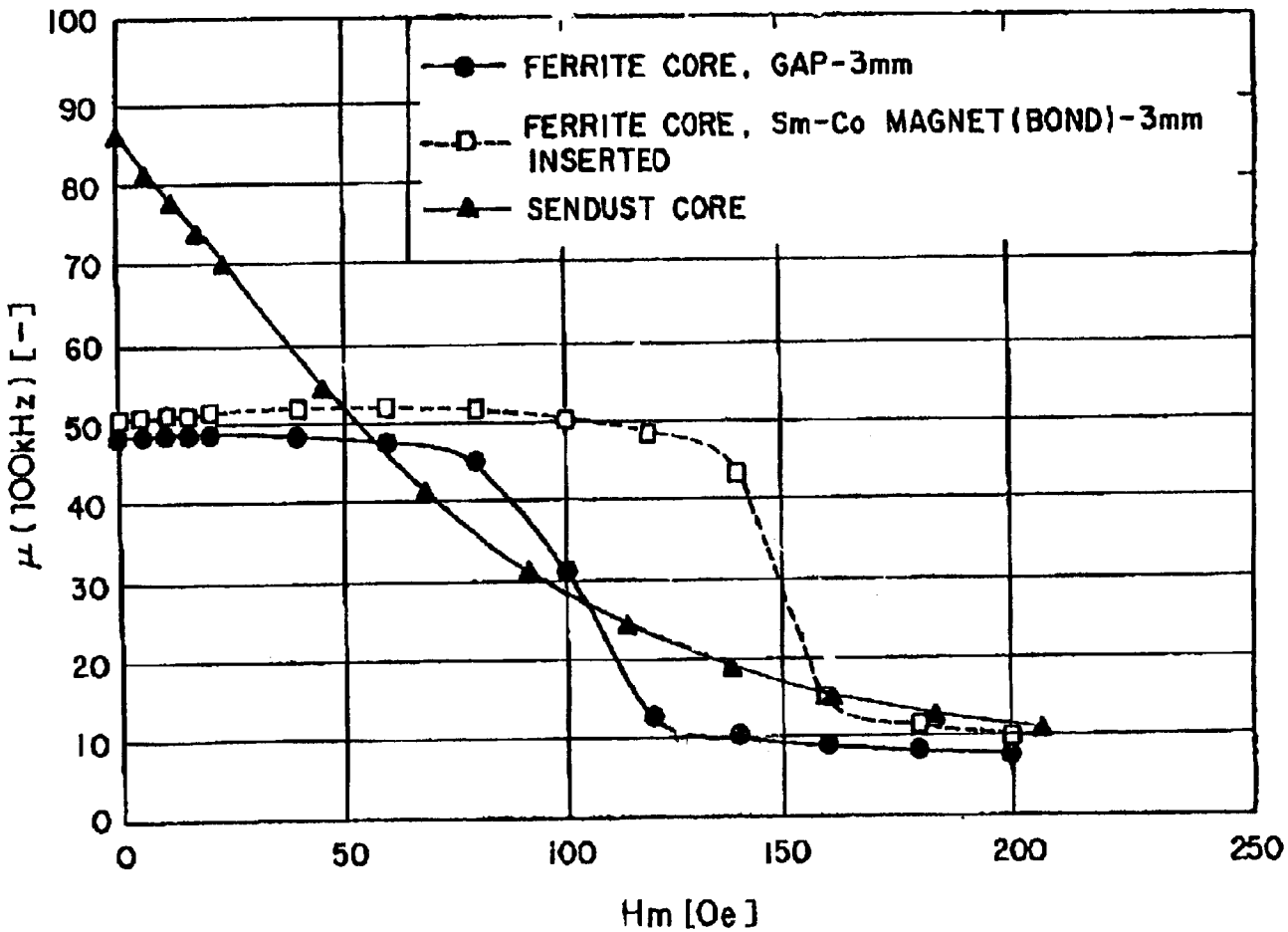
FIG. 7 is a graph showing the comparison among direct current superimposition characteristics of results of a Mn—Zn ferrite magnetic core with no magnet being inserted, a Mn—Zn ferrite magnetic core with a Sm—Fe—N bonded magnet being inserted, and a Sendust magnetic core in Example 2.

As is clear from FIG. 7, when comparison of the magnetic permeability in a direct current superimposed magnetic field of 100 Oe is performed, regarding the Sendust magnetic core, the magnetic permeability is less than 30, and regarding the Mn—Zn ferrite magnetic core with no magnet, the magnetic permeability is 30, although regarding the ferrite magnetic core with Sm—Fe—N magnet being inserted, the magnetic permeability is 45 or more and, therefore, superior characteristic is exhibited.

Next, the core loss characteristic was measured at room temperature with a SY-8232 alternating current BH tracer manufactured by Iwatsu Electric Co., Ltd., under the conditions of 20 kHz and 0.1 T. The results thereof are shown in Table 2.

TABLE 2

| sample | core loss ($kW/m^3$) |
|---|---|
| ferrite core with magnet inserted | 24 |
| ferrite core without magnet (gap) | 8.5 |
| sendust core | 120 |

As is clear from Table 2, the magnetic core with a magnet being inserted has a core loss of 24 $kW/m^3$ and, therefore, the core loss is a fifth of that of the Sendust magnetic core. Furthermore, the increase in core loss is relatively small compared to that of the ferrite magnetic core with no magnet being inserted.

These results show that the magnetic core with the magnet being inserted into the gap has superior direct current superimposition characteristic and superior core loss characteristic with a small degree of degradation.

EXAMPLE 3

Each of Sm—Co magnet powders having an average particle diameter of 5 $\mu$m was mixed with respective epoxy resins as a binder in an amount of 2 wt %, 5 wt %, 10 wt %, 20wt %, 30 wt %, or 40 wt % of the total weight. Then, die molding was carried out and, therefore, a bonded magnet having a size of 7×10 mm and a height of 3.0 mm was produced.

The resulting bonded magnet was magnetized with an electromagnet in the direction of the magnetic path, and was inserted into the gap portion of the Mn—Zn ferrite magnetic core used in Example 1. Subsequently, the core loss characteristic was measured at room temperature with a SY-8232 alternating current BH tracer manufactured by Iwatsu Electric Co., Ltd., under the conditions of 20 kHz and 0.1 T. Furthermore, the direct current superimposition characteristic was measured with a 4284A LCR meter manufactured by Hewlet Packerd under the conditions of an alternating current magnetic field frequency of 100 kHz and a superimposed magnetic field of 0 to 200 Oe. These measurement data are shown in Table 3.

TABLE 3

| amount of binder (wt %) | resistivity ($\Omega \cdot cm$) | core loss ($kW/m^3$) | residual flux density Br (G) | permeability $\mu$100 kHz |
|---|---|---|---|---|
| 2 | $2.0 \times 10^{-3}$ | 230 | 4600 | 52 |
| 5 | 1.0 | 72 | 3800 | 50 |
| 10 | 2.5 | 40 | 3000 | 50 |
| 20 | 12.5 | 32 | 1800 | 48 |

TABLE 3-continued

| amount of binder (wt %) | resistivity (Ω · cm) | core loss (kW/m$^3$) | residual flux density Br (G) | permeability μ100 kHz |
|---|---|---|---|---|
| 30 | $5.0 \times 10^2$ | 28 | 1250 | 40 |
| 40 | $2.5 \times 10^4$ | 26 | 850 | 12 |

As is clear from Table 3, the core loss decreases with increase in an amount of binder, and the sample containing 2 wt % of binder exhibits a very large core loss as 200 kW/m$^3$ or more.

The reason therefor is assumed to be that since the resistivity of the sample containing 2 wt % of binder is very small as $2.0\times10^{-3}$ Ω·cm, an eddy-current is increased and, therefore, the core loss is increased.

The sample containing 40 wt % of binder exhibits very small magnetic permeability in a direct current superimposed magnetic field of 100 Oe. The reason therefor is assumed to be that since the remanent magnetization of the bonded magnet is reduced due to large amounts of binder, the bias magnetic field is reduced and the direct current superimposition characteristic is not improved by a large degree.

The aforementioned results show that superior direct current superimposition characteristic can be achieved by inserting the bonded magnet containing the binder in an amount of 5 wt % or more, but 30 wt % or less and having a resistivity of 1 Ω·cm or more into the gap portion, and furthermore, the magnetic core has a core loss characteristic with a small degree of degradation and, therefore, superior magnetic core can be produced.

EXAMPLE 4

A sintered Sm—Co magnet having an energy product of about 28 MGOe was roughly pulverized, and thereafter, was classified into powders having the maximum particle diameter of 100 μm or less, 50 μm or less, and 30 μm or less with a standard sieve. Furthermore, a part of the roughly pulverized powder was finely pulverized in an organic solvent with a ball mill, and each of the powders having the maximum particle diameter of 10 μm or less and 5 μm or less was prepared from the resulting powder with a cyclone.

Each of the resulting magnet powders was mixed with 10 wt % of epoxy resin as a binder, and a bonded magnet was produced by die molding so as to have a size of 7×10 mm and a height of 0.5 mm. The characteristics of the bonded magnet were measured using a separately prepared test piece in a manner similar to that in Example 1, As a result, the intrinsic coercive forces of all test pieces were 5 kOe or more regardless of the maximum particle diameter of the powder. According to the result of the measurement of the resistivity, all magnets showed values of 1 Ω·cm or more.

Subsequently, the produced bonded magnet was inserted into the gap portion of the Mn—Zn ferrite magnetic core used in Example 1. Then, the permanent magnet was magnetized in the same manner with that in Example 1, and the core loss was measured under the conditions of 20 kHz and 0.1 T Herein, in the same manner with that in Example 1, the permanent magnet to be inserted was exchanged, while the same ferrite magnetic core was used, and the core loss was measured. The results thereof are shown in Table 4.

TABLE 4

| particle size | core loss (kW/m$^3$) |
|---|---|
| −5 μm | 32 |
| −10 μm | 40 |
| −30 μm | 105 |
| −50 μm | 160 |
| −100 μm | 200 |

As is clear from Table 4, the core loss rapidly increases when the maximum particle diameter of the magnet powder exceeds 10 μm. This result shows that further superior core loss characteristic is exhibited when the particle diameter of the magnet powder is 10 μm or less.

As described above, according to Examples 1 to 3 of the present invention, the magnetic core having superior direct current superimposition characteristic and core loss characteristic can be produced with ease at low cost.

Next, another magnetic core according to the present invention will now be described. Another magnetic core according to the present invention is a magnetic core having at least one gap in a magnetic path, and including a permanent magnet as a magnet for magnetic bias in the neighborhood of the gap in order to apply magnetic bias from both ends of the gap. The aforementioned magnetic core is a dust core, and the aforementioned permanent magnet is a bonded magnet composed of a rare-earth magnet powder having an intrinsic coercive force of 15 kOe or more, a Curie point of 300° C. or more, and an average particle diameter of the powder of 2.0 to 50 μm and a resin.

Preferably, the bonded magnet as the magnet for magnetic bias contains 10 vol % or more of the resin and has a resistivity of 0.1 Ω·cm or more, The initial permeability of the dust core is preferably 100 or more.

In addition, according to the present invention, an inductor component can be configured by applying at least one coil having at least one turn to the magnetic core including a magnet for magnetic bias.

The inductor components include coils, choke coils, transformers, and other components indispensably including, in general, a magnetic core and a coil.

By using the dust core and the rare-earth bonded magnet, the magnetic core having superior direct current superimposition characteristic and core loss characteristic can be produced, and the magnetic core is used for coils and transformers.

In the present invention, research was conducted regarding the combination of the permanent magnet to be inserted and the core, and resulted in the discovery that when the dust core, preferably having an initial permeability of 100 or more, was used as the core, and the permanent magnet having a resistivity of 0.1 Ω·cm or more and an intrinsic coercive force of 15 kOe or more was used as the magnet to be inserted into the gap of the core, superior direct current superimposition characteristic could be achieved and the magnetic core having a core loss characteristic with no degradation could be produced. This is based on the finding of the fact that the magnet characteristic necessary for achieving superior direct current superimposition characteristic is an intrinsic coercive force rather than an energy product and, therefore, sufficiently high direct current superimposition characteristic can be achieved as long as the intrinsic coercive force is high, even when a permanent magnet having a high resistivity is used.

The magnet having a high resistivity and high intrinsic coercive force can be generally realized by the rare-earth bonded magnet, and the bonded magnet is produced by mixing the rare-earth magnet powder and the binder and by molding the resulting mixture. However, any composition may be used as long as the magnet powder has a high coercive force. The kind of the rare-earth magnet powder may be any of SmCo-base, NdFeB-base, and SmFeN-base, although in consideration of thermal demagnetization during the use, the magnet must has a Tc of 300° C. or more and a coercive force of 5 kOe or more. As the resin, thermoplastic resins and thermosetting resins may be used, and an increase in eddy-current loss was prevented by the use of these resins.

The shape of the dust core is not specifically limited, although toroidal cores are generally used, and pot cores may be used. Each of these cores includes at least one gap in the magnetic path, and the permanent magnet is inserted into the gap. The gap length is not specifically limited, although when the gap length is excessively reduced, the direct current superimposition characteristic is degraded, and when the gap length is excessively increased, the magnetic permeability is excessively reduced and, therefore, the gap length to be formed is inevitably determined.

The value of the initial permeability before the formation of the gap is important, and since when the initial permeability is excessively low, the bias due to the magnet is not effective, the initial permeability must be 100 or more.

Regarding the characteristics required of the permanent magnet to be inserted into the gap, when the intrinsic coercive force is 15 kOe or less, the coercive force disappears due to the direct current magnetic field applied to the magnetic core and, therefore, the permanent magnet must have the coercive force of 15 kOe or more. Furthermore, the higher resistivity is the better, and when the resistivity is 0.1 Ω·cm or more, the core loss characteristic is excellent up to high frequencies.

When the average maximum particle diameter of the magnet powder is 50 μm or more, the core loss characteristic is degraded regardless of increase in the resistivity of the core and, therefore, the average maximum particle diameter of the powder is preferably 50 μm or less. However, when the minimum particle diameter becomes 2.0 μm or less, the magnetization is reduced remarkably due to oxidation of the powder during kneading of the powder and the resin and, therefore, the particle diameter must be 2.0 μm or more.

The amount of the resin must be 10 vol % or more in order to prevent an increase in core loss.

Other Examples according to the present invention will be described below.

EXAMPLE 5

Figure 8:
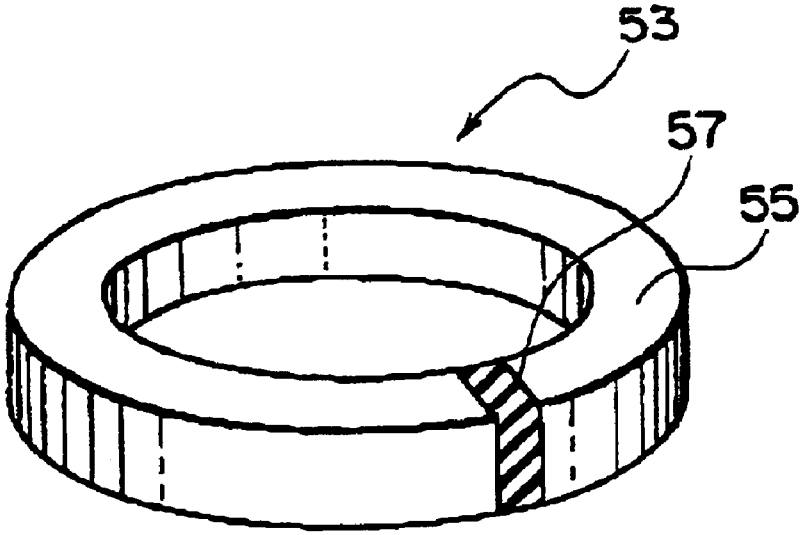
FIG. 8 is a perspective view of a toroidal core used for a choke coil according to an embodiment of the present invention.

A sintered material was formed from a powder of pulverized ingot of $Sm_2Co_{17}$ by common powder metallurgy, and the resulting sintered material was subjected to the heat treatment for making into a magnet. Subsequently, fine pulverization was performed so as to prepare magnet powders having average particle diameters of about 3.5 μm, 4.5 μm, 5.5 μm, 6.5 μm, 7.5 μm, 8.5 μm, and 9.5 μm. Each of these magnet powders was subjected to an appropriate coupling treatment, and was mixed with 40 vol % of epoxy resin as a thermosetting resin. The resulting mixture was molded using a die under application of a pressure of 3 t/cm$^2$ and, therefore, a bonded magnet was produced. Herein, the bonded magnet was molded using the die having the same cross-sectional shape with that of the toroidal dust core 55 shown in FIG. 8. On the other hand, the intrinsic coercive force iHc was measured using a separately prepared test piece (TP) having a diameter of 10 and a thickness of 10 with a direct current BH tracer. The results thereof are shown in Table 5.

As the dust core, a Fe—Al—Si magnetic alloy (trade name of Sendust) powder was molded into a toroidal core 55 having a size of 27 mm in external diameter, 14 mm in inner diameter, and 7 mm in thickness. The initial permeability of this core was 120.

Figure 9:
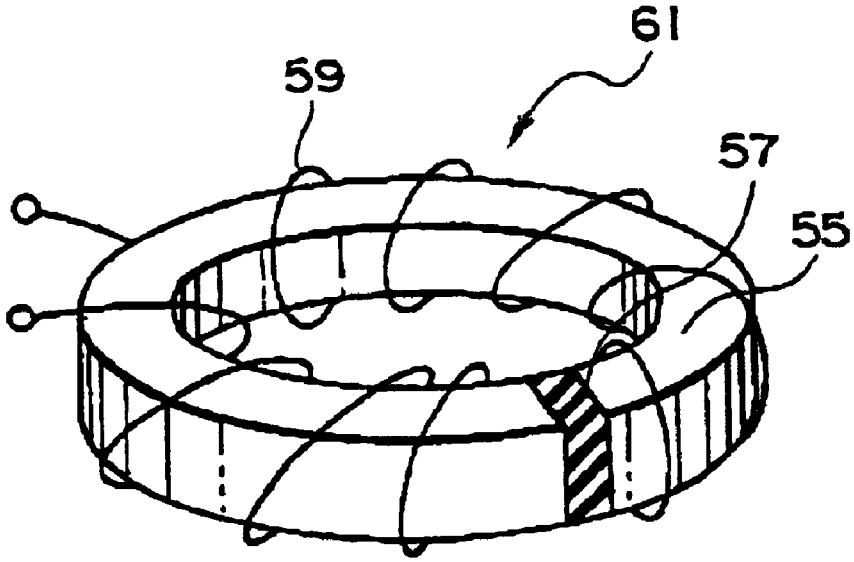
FIG. 9 is a perspective view of a choke coil configured by applying a coil to the toroidal core in FIG. 8.
Figure 10:
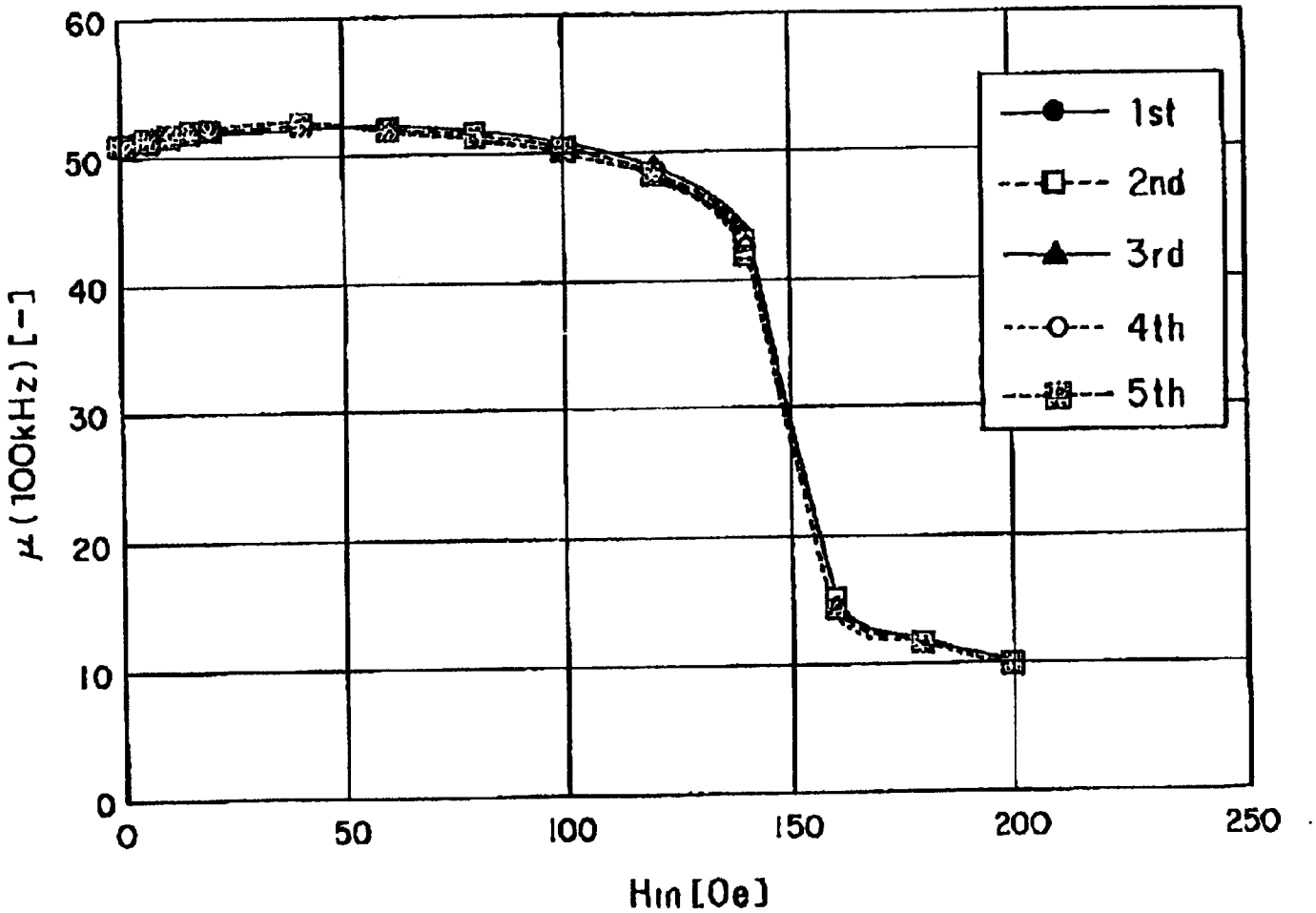
FIG. 10 is a graph showing measurement data of the direct current superimposition characteristic regarding a thin plate magnet composed of a $Sm_2Co_{17}$ magnet and a polyimide resin in Example 8.

This toroidal core was processed to have a gap of 0.5 mm. The bonded magnet 57 produced as described above was inserted into the aforementioned gap portion. The magnet 57 was magnetized by an electromagnet in the direction of the magnetic path of the core 55. Thereafter, a coil 59 was applied as shown in FIG. 9, and the direct current superimposition characteristic was measured. The applied direct current was 150 Oe in terms of direct current magnetic field. The measurement was repeated ten times. The results thereof are shown in Table 5. The measurement results regarding the core with no magnet being inserted into the gap are also shown side by side in Table 5 for purposes of comparison.

TABLE 5

| | without magnet | particle diameter of magnet powder (μm) 3.5 | 4.5 | 5.5 | 6.5 | 7.5 |
|---|---|---|---|---|---|---|
| iHc (Oe) of TP | — | 10 | 14 | 17 | 19 | 20 |
| μ at 150 Oe | 20 | 24 | 25 | 25 | 26 | 25 |
| μ after 10 times measurement | 20 | 20 | 21 | 24 | 25 | 25 |

As is clear from Table 5, when the coercive force is 15 kOe or more, the degradation of the direct current superimposition characteristic does not occur even if the direct current magnetic field was applied repeatedly.

EXAMPLE 6

A SmFe powder produced by a reduction and diffusion method was finely pulverized into 3 μm, and subsequently, a nitriding treatment was performed and, therefore, a Sm—Fe—N powder was prepared as a magnet powder. 3 wt % of Zn powder was mixed into the resulting powder, and the resulting mixture was heat-treated at 500° C. for 2 hours in Ar. The powder characteristic thereof was measured with VSM, and as a result, the coercive force was about 20 kOe.

Then, 45 vol % of 6 nylon as a thermoplastic resin was mixed with the magnet powder to form a mixture. The resulting mixture was hot kneaded at 230° C., was hot pressed at the same temperature so as to have a thickness of 0.2 mm and, therefore, a sheet-like bonded magnet was produced.

The bonded magnet sheet was punched into a disk of 10 mm in diameter, and the disks were stacked to have a thickness of 10 mm. The magnetic characteristic of the stacked disks was measured, and as a result, the intrinsic coercive force was about 18 kOe. The resistivity was measured with the result of 0.1 Ω·cm or more.

On the other hand, regarding the dust core, each of toroidal dust cores having an initial permeability of 75, 100, 150, 200, or 300 was produced in the same manner with that in Example 5 by changing the shape of the Sendust powder and the filling factor of the powder.

Then, gap lengths were adjusted in order that the initial permeability become within 50 to 60 at any level of the dust cores having different initial permeability.

The bonded magnet was inserted into the gap with no clearance. Therefore, the magnet sheets were inserted while being superimposed or polished if necessary.

Table 6 shows the measurement results of the magnetic permeability $\mu e$ in the direct current superimposed magnetic field of 150 Oe. The core loss characteristic at 20 kHz and 100 mT is also shown. The dust core having an initial permeability of 75 exhibits a direct current superimposition characteristic $\mu e$ of 16 and a core loss of 100.

TABLE 6

| | permeability of dust core (–) | | | | |
|---|---|---|---|---|---|
| characteristic | 75 | 105 | 150 | 200 | 300 |
| DC superposition characteristic $\mu e$(–) | 18 | 26 | 28 | 30 | 33 |
| core loss (kW/m$^3$) | 90 | 100 | 120 | 150 | 160 |

As is clear from Table 6, when the initial permeability of the dust core becomes less than 100, improvement of the superimposition characteristic is not observed. This shows that when the initial permeability of the dust core is excessively reduced, the flux of the magnet takes a shortcut and does not pass through the core, and, therefore, the initial permeability of the core must be at least 100.

Another embodiment according to the present invention will now be described.

In the magnetic core according to the present invention, a thin plate magnet is used. This thin plate magnet contains one kind of resin and a magnet powder dispersing in the resin, and the resin is selected from the group consisting of poly(amide-imide) resins, polyimide resins, epoxy resins, poly(phenylene sulfide) resins, silicone resins, polyester resins, aromatic polyamides, and liquid crystal polymers. The resin content is 30 vol % or more, and the total thickness is 500 $\mu$m or less. Herein, the magnet powder preferably has an intrinsic coercive force of 10 kOe or more, Tc is 500° C. or more, and an average particle diameter of the particle of 2.5 to 50 $\mu$m.

In the thin plate magnet according to the present invention, the magnet powder may be a rare-earth magnet powder.

The thin plate magnet preferably has the surface glossiness of 25% or more.

The thin plate magnet preferably has a molding compressibility of 20% or more.

In an embodiment according to the present invention, the magnet powder may be coated with a surfactant.

The aforementioned thin plate magnet preferably has a resistivity of 0.1 Ω·cm or more.

The magnetic core according to the present embodiment is a magnetic core having at least one gap in a magnetic path, and including a permanent magnet as a magnet for magnetic bias in the neighborhood of the magnetic gap in order to apply magnetic bias from both ends of the gap. The permanent magnet is the thin plate magnet. Preferably, the magnetic gap has a gap length of about 500 $\mu$m or less, and the magnet for magnetic bias has a thickness equivalent to, or less than, the gap length, and is magnetized in the direction of the thickness.

In addition, an inductor component can be produced by applying at least one coil having at least one turn to the magnetic core including the thin plate magnet as a magnet for magnetic bias, and the resulting inductor component is low-profile and exhibits an excellent direct current superimposition characteristic and a low core loss.

Regarding the present invention, research was conducted on the possibility of the use of a thin plate magnet having a thickness of 500 $\mu$m or less as the permanent magnet for magnetic bias inserted into the magnet gap of the magnetic core. As s result, superior direct current superimposition characteristic could be achieved when the used thin plate magnet contained 30 vol % or more of specified resin, and had a resistivity of 0.1 Ω·cm or more and an intrinsic coercive force of 10 kOe or more, and furthermore, a magnetic core having a core loss characteristic with no degradation could be formed. This is based on the finding of the fact that the magnet characteristic necessary for achieving superior direct current superimposition characteristic is an intrinsic coercive force rather than an energy product and, therefore, sufficiently high direct current superimposition characteristic can be achieved as long as the intrinsic coercive force is high, even when a permanent magnet having a high resistivity is used.

The magnet having a high resistivity and high intrinsic coercive force can be generally achieved by a rare-earth bonded magnet, and the rare-earth bonded magnet is produced by mixing the rare-earth magnet powder and the binder and by molding the resulting mixture. However, any composition may be used as long as the magnet powder has a high coercive force. The kind of the rare-earth magnet powder may be any of SmCo-base, NdFeB-base, and SmFeN-base, although in consideration of thermal demagnetization during the use, for example, reflow, the magnet must has a Curie point Tc of 500° C. or more and an intrinsic coercive force iHc of 10 kOe or more.

When the magnet powder is coated with a surfactant, since dispersion of the powder in the molding becomes excellent, and the characteristics of the magnet are improved, a magnetic core having higher characteristics can be produced.

Any soft magnetic material may be effective as the material for the magnetic core for a choke coil and transformer, although, in general, MnZn ferrite or NiZn ferrite, dust cores, silicon steel plates, amorphous, etc., are used.

The shape of the magnetic core is not specifically limited and, therefore, the present invention can be applied to magnetic cores having any shape, for example, toroidal cores, EE cores, and EI cores. The core includes at least one gap in the magnetic path, and a thin plate magnet is inserted into the gap. The gap length is not specifically limited, although when the gap length is excessively reduced, the direct current superimposition characteristic is degraded, and when the gap length is excessively increased, the magnetic permeability is excessively reduced and, therefore, the gap length to be formed is inevitably determined. The gap length may be limited to 500 $\mu$m or less in order to reduce the size of the whole core.

Regarding the characteristics required of the thin plate magnet to be inserted into the gap, when the intrinsic coercive force is 10 kOe or less, magnetization disappears due to a direct current superimposed magnetic field applied to the magnetic core and, therefore, a coercive force is required to be 10 kOe or more. The greater resistivity is the better. However, the resistivity does not become a primary factor of one gradation of the core loss as long as the resistivity is 0.1 Ω·cm or more. When the average maximum particle diameter of the powder becomes 50 $\mu$m or more, the core loss characteristics are degraded and, therefore, the maximum average particle diameter of the powder is preferably 50 μm or less. When the minimum particle diameter becomes 2.5 μm or less, the magnetization is reduced remarkably due to oxidation of the powder during heat treatment of the powder and reflow. Therefore, the particle diameter must be 2.5 μm or more.

Another embodiment according to the present invention will be described below.

EXAMPLE 7

A $Sm_2Co_{17}$ magnet powder and a polyimide resin were hot-kneaded by using a Labo Plastomill as a hot kneader. The kneading was performed at various resin contents chosen within the range of 15 vol % to 40 vol %. The molding of the resulting hot-kneaded material into a thin plate magnet of 0.5 mm was attempted by using a hot-pressing machine. As a result, the resin content had to be 30 vol % or more in order to perform the molding. Regarding the present embodiment, the above description is only related to the results on the thin plate magnet containing a polyimide resin. However, results similar to those described above were derived from each of the thin plate magnets containing an epoxy resin, poly(phenylene sulfide) resin, silicone resin, polyester resin, aromatic polyamide, or liquid crystal polymer other than the polyimide resin.

EXAMPLE 8

Each of the magnet powders and each of the resins were hot-kneaded at the compositions shown in the following Table 7 by using a Labo Plastomill. Each of the set temperature of the Labo Plastomill during operation was specified to the temperature 5° C. higher than the softening temperature of each of the resins.

TABLE 7

Composition of Thin Plate Magnet of Example 8

| | composition | iHc (kOe) | mixing ratio (weight part) |
|---|---|---|---|
| ① | $Sm_2Co_{17}$ magnet powder | 15 | 100 |
| | polyimide resin | — | 50 |
| ② | $Sm_2Co_{17}$ magnet powder | 15 | 100 |
| | epoxy resin | — | 50 |
| ③ | $Sm_2Fe_{17}N$ magnet powder | 10.5 | 100 |
| | polyimide resin | — | 50 |
| ④ | Ba Ferrite Magnet Powder | 4.0 | 100 |
| | polyimide resin | — | 50 |
| ⑤ | $Sm_2Co_{17}$ magnet powder | 15 | 100 |
| | polypropylene resin | — | 50 |

The resulting material hot-kneaded with the Labo Plastomill was die-molded into a thin plate magnet of 0.5 mm by using a hot-pressing machine without magnetic field. This thin plate magnet was cut so as to have the same cross-sectional shape with that of the central magnetic leg of the E type ferrite core 45 shown in FIGS. 1A and 1B.

Subsequently, as shown in FIGS. 1A and 1B, a central leg of an EE type core was processed to have a gap of 0.5 mm. The EE type core was made of common Mn—Zn ferrite material and had a magnetic path length of 7.5 cm and an effective cross-sectional area of 0.74 $cm^2$. The thin plate magnet 43 produced as described above was inserted into the gap portion and, therefore, a magnetic core having a magnetic bias magnet 43 was produced. In the drawing, reference numeral 43 denotes the thin plate magnet and reference numeral 45 denotes the ferrite core. The magnet 43 was magnetized in the direction of the magnetic path of the core 45 with a pulse magnetizing apparatus, a coil 47 was applied to the core 45, and an inductance L was measured with a 4284 LCR meter manufactured by Hewlet Packerd under the conditions of an alternating current magnetic field frequency of 100 kHz and a superimposed magnetic field of 0 to 200 Oe. Thereafter, the inductance L was measured again after keeping for 30 minutes at 270° C. in a reflow furnace, and this measurement was repeated five times. At this time, the direct current superimposed current was applied and, therefore, the direction of the magnetic field due to the direct current superimposition was reverse to the direction of the magnetization of the magnetic bias magnet. The permeability was calculated from the resulting inductance L, core constants (core size, etc.), and the number of turns of coil and, therefore, the direct current superimposition characteristic was determined. FIGS. 10 to 14 show the direct current superimposition characteristics of each cores based on the five times of measurements.

Figure 14:
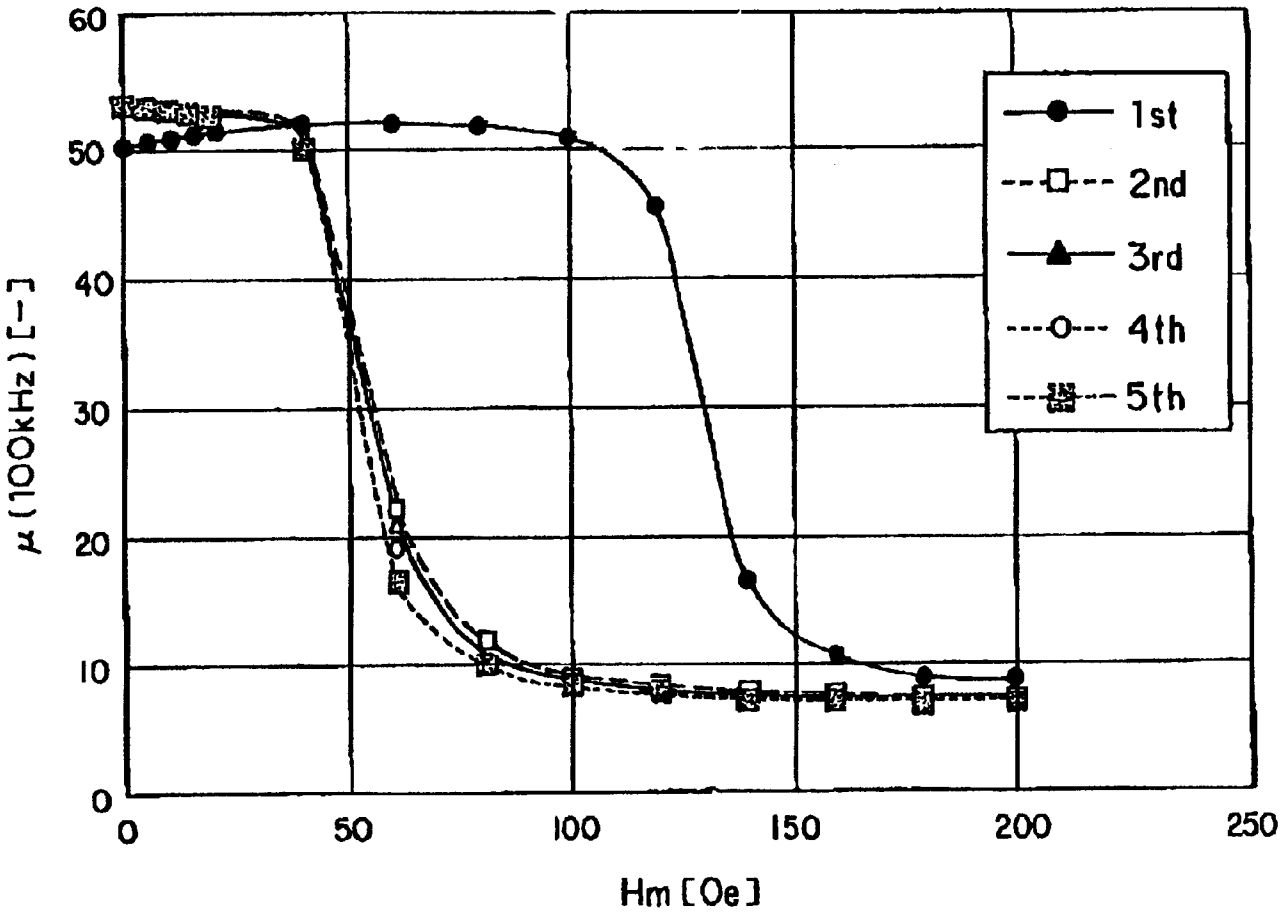
FIG. 14 is a graph showing measurement data of the direct current superimposition characteristic regarding a thin plate magnet composed of a $Sm_2Co_{17}$ magnet and a polypropylene resin in Example 8.
Figure 15:
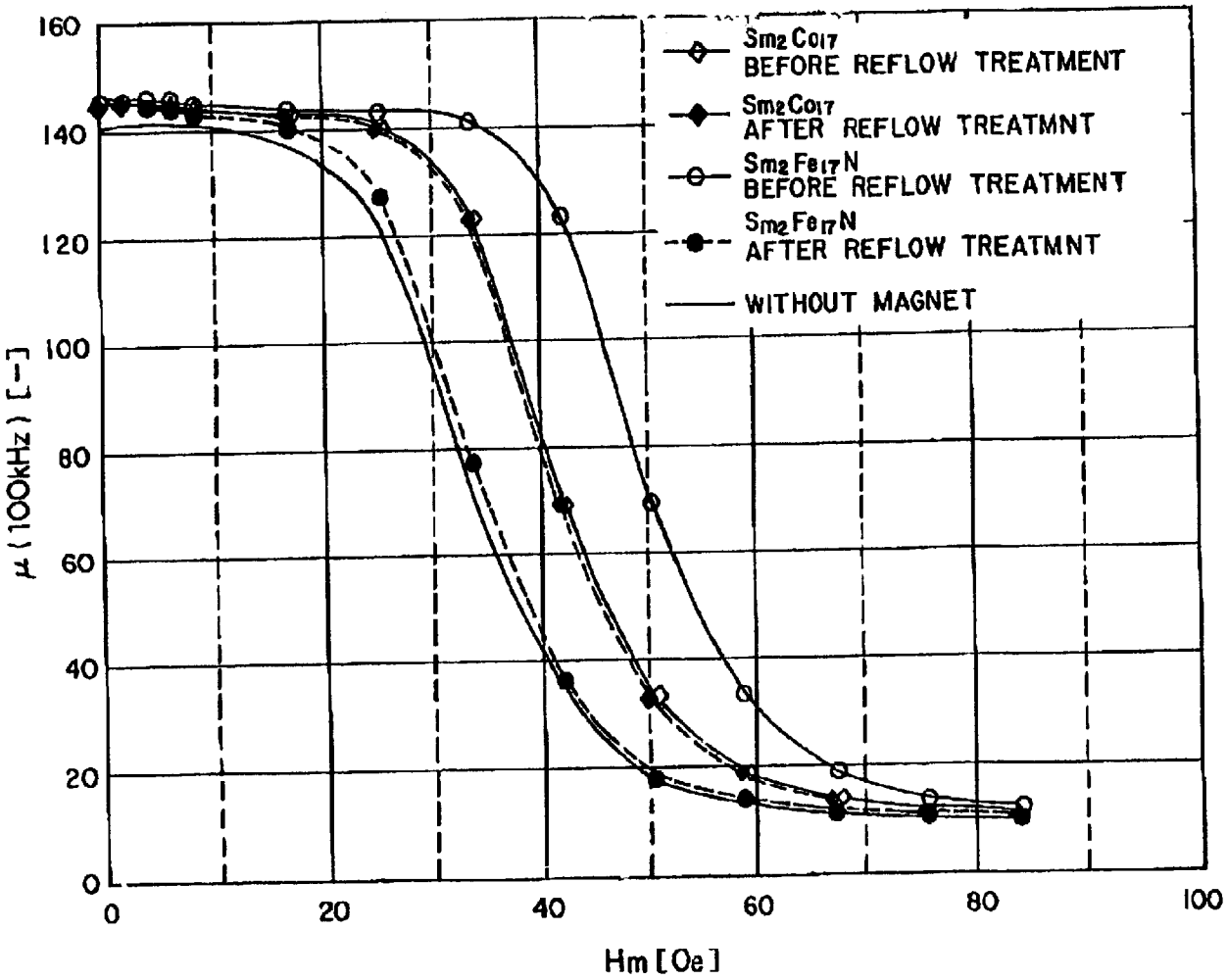
FIG. 15 is a graph showing measurement data of the direct current superimposition characteristic before and after the reflow, in the case where a thin plate magnet made of Sample 2 or 4 is used and in the case where no thin plate magnet is used, in Example 14.

As is clear from FIG. 14, the direct current superimposition characteristic is degraded by a large degree in the second measurement or later regarding the core with the thin plate magnet being inserted and composed of a $Sm_2Co_{17}$ magnet powder dispersed in a polypropylene resin. This degradation is due to deformation of the thin plate magnet during the reflow. As is clear from FIG. 13, the direct current superimposition characteristic is degraded by a large degree with increase in number of measurements regarding the core with the thin plate magnet being inserted, while this thin plate magnet is composed of Ba ferrite having a coercive force of only 4 kOe dispersed in a polyimide resin. On the contrary, as is clear from FIGS. 10 to 12, large changes are not observed in the repeated measurements and very stable characteristics are exhibited regarding the cores with the thin plate magnets being inserted, while the thin plate magnets use the magnet powder having a coercive force of 10 kOe or more and a polyimide or epoxy resin. From the results, the reason for the degradation of the direct current superimposition characteristic can be assumed that since the Ba ferrite thin plate magnet has a small coercive force, reduction of magnetization or inversion of magnetization is brought about by a magnetic field in the reverse direction applied to the thin plate magnet. Regarding the thin plate magnet to be inserted into the core, when the thin plate magnet has a coercive force of 10 kOe or more, superior direct current superimposition characteristic is exhibited. Although not shown in the present embodiment, the effects similar to the aforementioned effects were reliably achieved regarding combinations other than that in the present embodiment and regarding thin plate magnets produced by using a resin selected from the group consisting of poly(phenylene sulfide) resins, silicone resins, polyester resins, aromatic polyamides, and liquid crystal polymers.

EXAMPLE 9

Each of the $Sm_2Co_{17}$ magnet powders and 30 vol % of poly(phenylene sulfide) resin were hot-kneaded using a Labo Plastomill. Each of the magnet powders had a particle diameter of 1.0 μm, 2.0 μm, 25 μm, 50 μm, or 55 μm. Each of the resulting materials hot-kneaded with the Labo Plastomill was die-molded into a thin plate magnet of 0.5 mm with a hot-pressing machine without magnetic field. This thin plate magnet 43 was cut so as to have the same cross-sectional shape with that of the central leg of the E type ferrite core 45 and, therefore, a core as shown in FIGS. 1A and 1B was produced. Subsequently, the thin plate magnet 43 was magnetized in the direction of the magnetic path of the core 45 with a pulse magnetizing apparatus, a coil 47 was applied to the core 45, and a core loss characteristic was measured with a SY-8232 alternating current BH tracer manufactured by Iwatsu Electric Co., Ltd., under the conditions of 300 kHz and 0.1 T at room temperature. The results thereof are shown in Table 8. As is clear from Table 8, superior core loss characteristics were exhibited when the average particle diameters of the magnet powder used for the thin plate magnet were within the range of 2.5 to 50 $\mu$m.

TABLE 8

Measurement of LOSS in Example 9

| | | | | | |
|---|---|---|---|---|---|
| particle diameter ($\mu$m) | 2.0 | 2.5 | 25 | 50 | 55 |
| core loss (kW/m$^3$) | 670 | 520 | 540 | 555 | 790 |

EXAMPLE 10

Hot-kneading of 60 vol % of $Sm_2Co_{17}$ magnet powder and 40 vol % of polyimide resin was performed by using a Labo Plastomill. Moldings of 0.3 mm were produced from the resulting hot-kneaded materials by a hot-pressing machine while the pressures for pressing were changed. Subsequently, magnetization was performed with a pulse magnetizing apparatus at 4 T and, therefore, thin plate magnets were produced. Each of the resulting thin plate magnets had a glossiness of within the range of 15% to 33%, and the glossiness increased with increase in pressure of the pressing. These moldings were cut into 1 cm×1 cm, and the flux was measured with a TOEI TDF-5 Digital Flux meter. The measurement results of the flux and glossiness are shown side by side in Table 9.

TABLE 9

Measurement of Flux in Example 10

| | | | | | | |
|---|---|---|---|---|---|---|
| glossiness (%) | 15 | 21 | 23 | 26 | 33 | 45 |
| flux (Gauss) | 42 | 51 | 54 | 99 | 101 | 102 |

As shown in Table 9, the thin plate magnets having a glossiness of 25% or more exhibit superior magnetic characteristics. The reason therefor is that the filling factor becomes 90% or more when the produced thin plate magnet has a glossiness of 25% or more. Although only the results of experiments using the polyimide resin are described in the present embodiment, the results similar to the aforementioned results were exhibited regarding one kind of resin selected from the group consisting of epoxy resins, poly (phenylene sulfide) resins, silicone resins, polyester resins, aromatic polyamides, and liquid crystal polymers other than the aforementioned resin.

EXAMPLE 11

A $Sm_2Co_{17}$ magnet powder, RIKACOAT (polyimide resin) manufactured by New Japan Chemical Co., Ltd., and γ-butyrolactone as a solvent were mixed and agitated with a centrifugal deaerator for 5 minutes, and subsequently, kneading was performed with a triple roller mill and, therefore, paste was produced. If the paste was dried, the composition became 60 vol % of $Sm_2Co_{17}$ magnet powder and 40 vol % of polyimide resin. The blending ratio of the solvent, γ-butyrolactone, was specified to be 10 parts by weight relative to the total of the $Sm_2Co_{17}$ magnet powder and RIKACOAT manufactured by New Japan Chemical Co., Ltd., of 70 parts by weight. A green sheet of 500 $\mu$m was produced from the resulting paste by a doctor blade method, and drying was performed. The dried green sheet was cut into 1 cm×1 cm, a hot press was performed with a hot-pressing machine while the pressures for pressing were changed, and the resulting moldings were magnetized with a pulse magnetizing apparatus at 4 T and, therefore, thin plate magnets were produced. A molding with no hot press was also made to be a magnet by magnetization for purposes of comparison. At this time, production was performed at the blending ratio, although components and blending ratios other than the above description may be applied as long as a paste capable of making a green sheet can be produced. Furthermore, the triple roller mill was used for kneading, although a homogenizer, sand mill, etc, may be used other than the triple roller mill. Each of the resulting thin plate magnets had a glossiness of within the range of 9% to 28%, and the glossiness increased with increase in pressure of the pressing. The flux of the thin plate magnet was measured with a TOEI TDF-5 Digital Flux meter and the measurement results are shown in Table 10. Table 10 also shows side by side the results of the measurement of compressibility in hot press (=1-thickness after hot press/thickness before hot press) of the thin plate magnet at this time.

TABLE 10

Measurement of Flux in Example 11

| | | | | | | |
|---|---|---|---|---|---|---|
| glossiness (%) | 9 | 13 | 18 | 22 | 25 | 28 |
| flux (Gauss) | 34 | 47 | 51 | 55 | 100 | 102 |
| compressibility (%) | 0 | 6 | 11 | 14 | 20 | 21 |

As is clear from the aforementioned results, similarly to Example 10, excellent magnetic characteristics can be exhibited when the glossiness is 25% or more. The reason for this is also that the filling factor of the thin plate magnet becomes 90% or more when the glossiness is 25% or more. Regarding the compressibility, the results show that excellent magnetic characteristics can be exhibited when the compressibility is 20% or more.

Although the above description is related to the results of experiments using the polyimide resin at specified compositions and blending ratios in the present embodiment, the results similar to the aforementioned results were exhibited regarding one kind of resin selected from the group consisting of epoxy resins, poly(phenylene sulfide) resins, silicone resins, polyester resins, aromatic polyamides, and liquid crystal polymers, and blending ratios other than those in the above description.

EXAMPLE 12

A $Sm_2Co_{17}$ magnet powder and 0.5 wt % of sodium phosphate as a surfactant were mixed. Likewise, a $Sm_2Co_{17}$ magnet powder and 0.5 wt % of sodium carboxymethylcellulose were mixed, and a $Sm_2Co_{17}$ magnet powder and sodium silicate were mixed. 65 vol % of each of these mixed powder and 35 vol % of poly(phenylene sulfide) resin were hot-kneaded by using a Labo Plastomill. Each of the resulting materials hot-kneaded with the Labo Plastomill was molded into 0.5 mm by hot press and, therefore, a thin plate magnet was produced. The resulting thin plate magnet was cut so as to have the same cross-sectional shape with that of the central magnetic leg of the E type ferrite core 45 shown in FIGS. 1A and 1B in a manner similar to that in Example 8. The thin plate magnet 43 produced as described above was inserted into the central magnetic leg gap portion of the EE core 45 and, therefore, a core as shown in FIGS. 1A and 1B was produced. Subsequently, the thin plate magnet 43 was magnetized in the direction of the magnetic path of the core 45 with a pulse magnetizing apparatus, a coil 47 was applied to the core 45, and a core loss characteristic was measured with a SY-8232 alternating current BH tracer manufactured by Iwatsu Electric Co., Ltd., under the conditions of 300 kHz and 0.1 T at room temperature. The measurement results thereof are shown in Table 11. For purposes of comparison, the surfactant was not used, and 65 vol % of $Sm_2Co_{17}$ magnet powder and 35 vol % of poly (phenylene sulfide) resin were kneaded with the Labo Plastomill. The resulting hot-kneaded material was molded into 0.5 mm by hot press, and the resulting molding was inserted into the magnetic gap of the same ferrite EE core with that in the above description. Subsequently, this was magnetized in the direction of the magnetic path of the core with a pulse magnetizing apparatus, a coil was applied, and a core loss was measured. The results thereof are also shown side by side in Table 11.

TABLE 11

Measurement of Core Loss in Example 12

| sample | core loss ($kW/m^3$) |
|---|---|
| + sodium phosphate | 495 |
| + sodium carboxylmethylcellulose | 500 |
| + sodium silicate | 485 |
| no additive | 590 |

Figure 11:
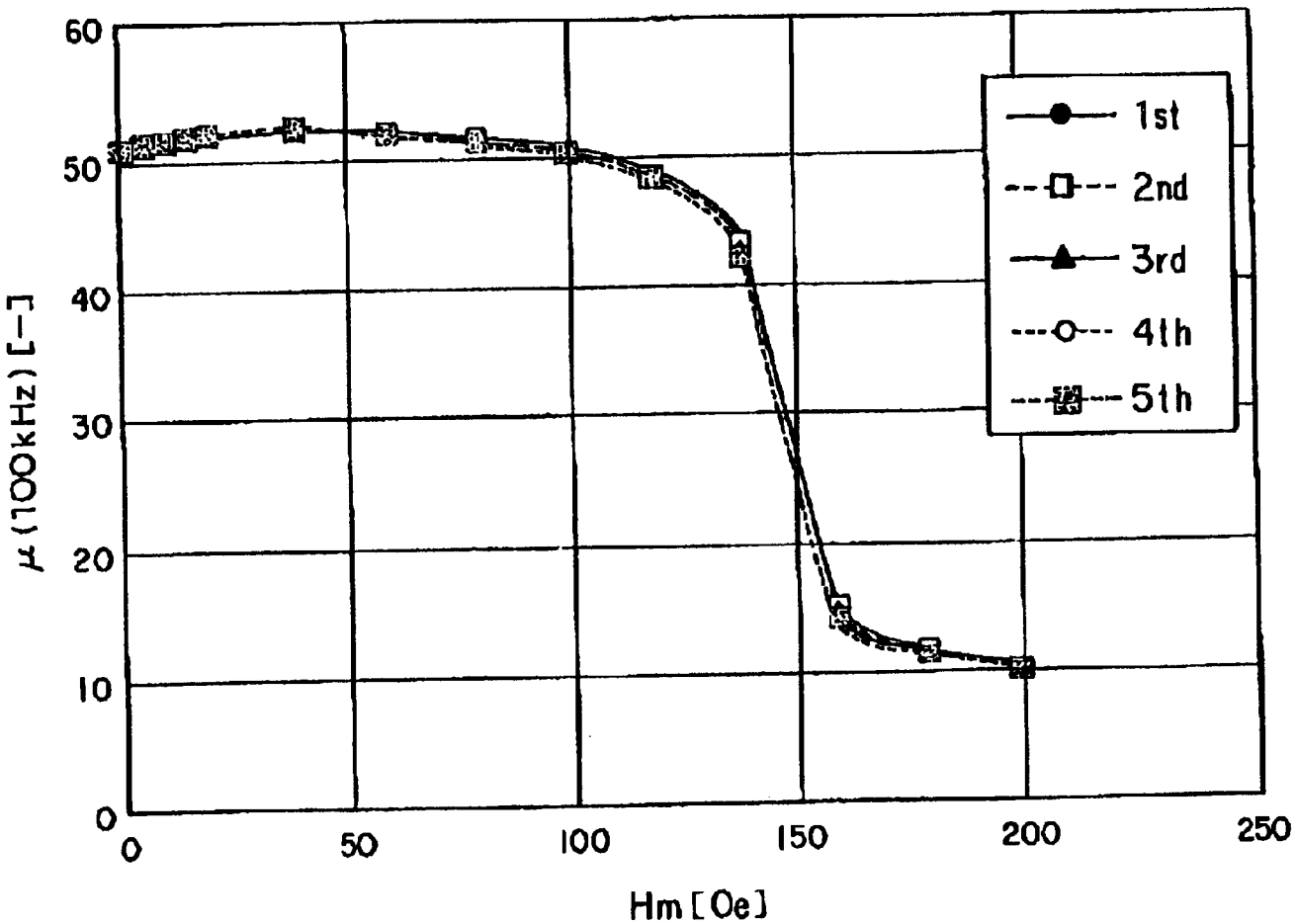
FIG. 11 is a graph showing measurement data of the direct current superimposition characteristic regarding a thin plate magnet composed of a $Sm_2Co_{17}$ magnet and an epoxy resin in Example 8.
Figure 12:
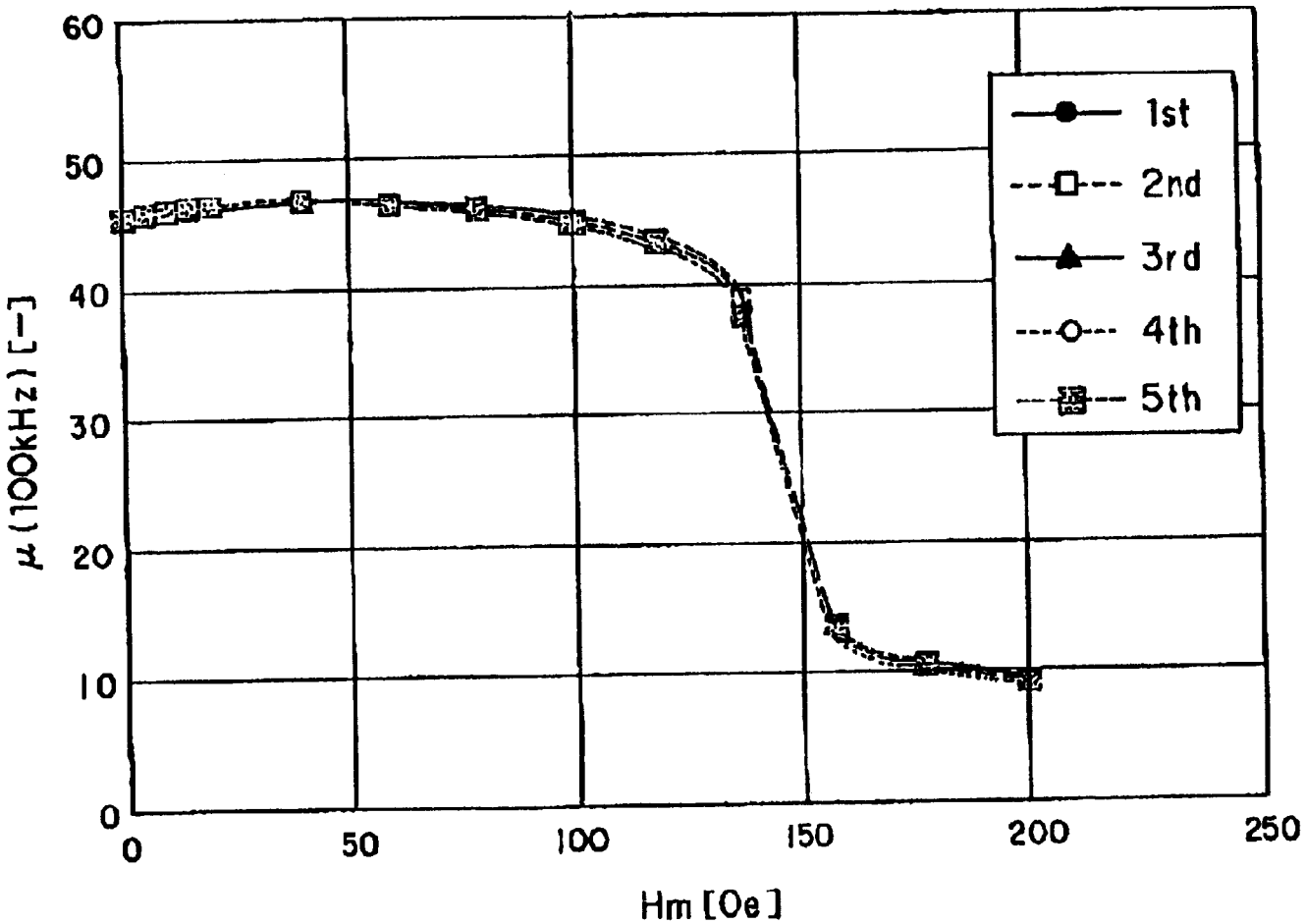
FIG. 12 is a graph showing measurement data of the direct current superimposition characteristic regarding a thin plate magnet composed of a $Sm_2Co_{17}N$ magnet and a polyimide resin in Example 8.
Figure 13:
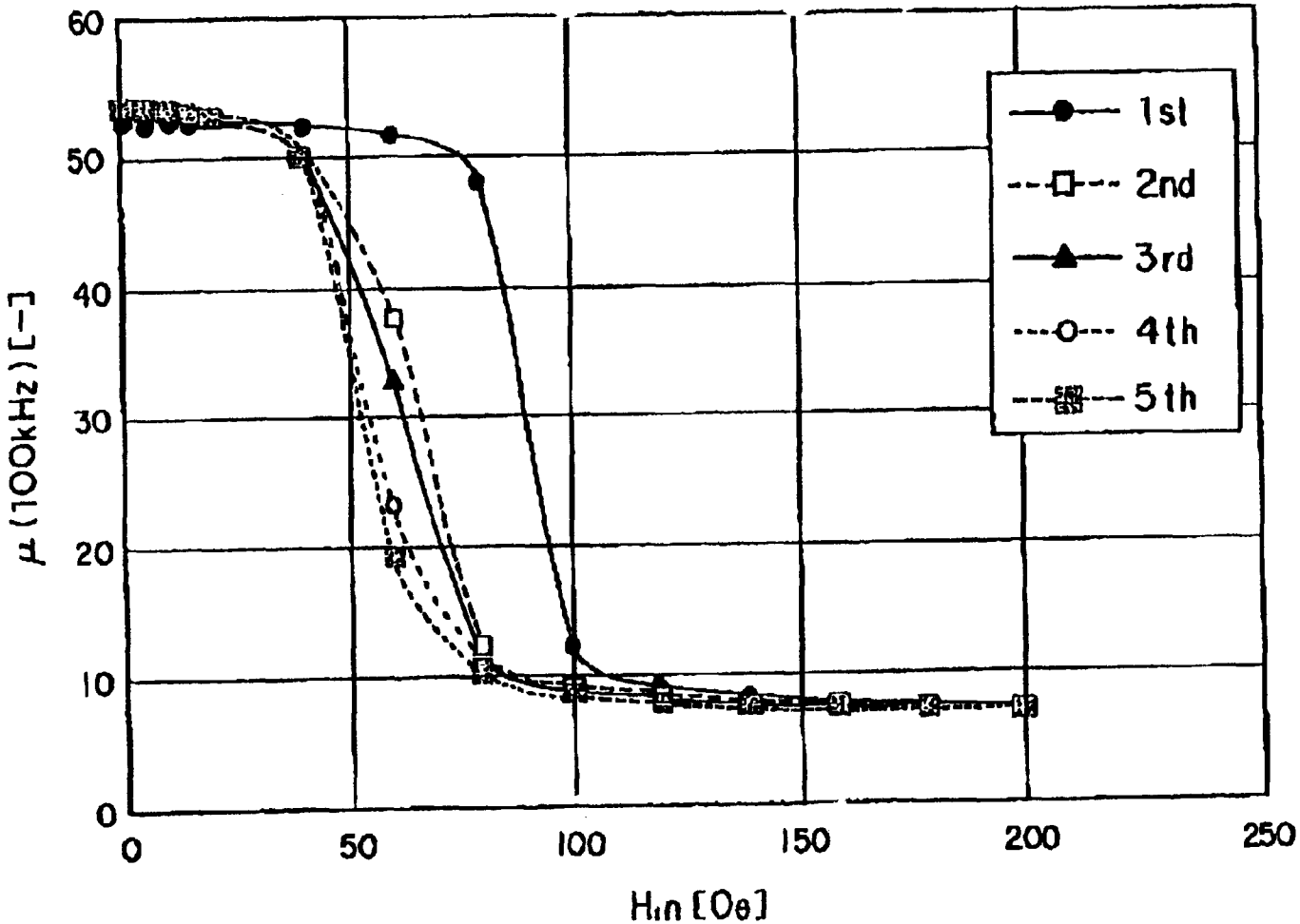
FIG. 13 is a graph showing measurement data of the direct current superimposition characteristic regarding a thin plate magnet composed of a Ba ferrite magnet and a polyimide resin in Example 8.

As shown in FIG. 11, excellent core loss characteristics are exhibited when the surfactant is added. The reason for this is that by the addition of the surfactant, coagulation of primary particles is prevented and the eddy current loss is alleviated. Although the above description is related to the results of addition of the phosphate in the present embodiment, similarly to the aforementioned results, excellent core loss characteristic, i.e., iron loss characteristic was exhibited when surfactants other than that in the above description were added.

EXAMPLE 13

A $Sm_2Co_{17}$ magnet powders and a polyimide resin were hot-kneaded with a Labo Plastomill. The resulting mixture was press-molded into a thin plate magnet of 0.5 mm in thickness with a hot-pressing machine without magnetic field. Herein, thin plate magnets, each having a resistivity of 0.05, 0.1, 0.2, 0.5, or 1.0 Ω·cm, were produced by controlling the content of the polyimide resin. Thereafter, this thin plate magnet was processed so as to have the same cross-sectional shape with that of the central magnetic leg of the E type ferrite core 45 shown in FIGS. 1A and 1B, in a manner similar to that in Example 8. Subsequently, the thin plate magnet 43 produced as described above was inserted into the magnetic gap of the central magnetic leg of the EE type core made of MnZn ferrite material and having a magnetic path length of 7.5 cm and an effective cross-sectional area of 0.74 $cm^2$. The magnetization in the direction of the magnetic path was performed with an electromagnet, a coil 47 was applied, and a core loss characteristic was measured with a SY-8232 alternating current BH tracer manufactured by Iwatsu Electric Co., Ltd., under the conditions of 300 kHz and 0.1 T at room temperature. Herein the same ferrite core was used in the measurements, and the core losses were measured while only the magnet was changed to other magnet having a different resistivity. The results thereof are shown in Table 12.

TABLE 12

Measurement of Core Loss in Example 13

| resistivity (Ω· cm) | 0.05 | 0.1 | 0.2 | 0.5 | 1.0 |
|---|---|---|---|---|---|
| core loss ($kW/m^3$) | 1220 | 530 | 520 | 515 | 530 |

As is clear from Table 12, excellent core loss characteristics are exhibited when the magnetic cores hail a resistivity of 0.1 Ω·cm or more. The reason for this is that the eddy current loss can be alleviated by increasing the resistivity of the thin plate magnet.

EXAMPLE 14

Each of the various magnet powders and each of the various resins were kneaded, molded, and processed at the compositions shown in Table 13 by the method as described below and, therefore, samples of 0.5 mm in thickness were produced. Herein, A $Sm_2Co_{17}$ powder and a ferrite powder were pulverized powders of sintered materials. A $Sm_2Fe_{17}N$ powder was a powder produced by subjecting the $Sm_2Fe_{17}$ powder produced by a reduction and diffusion method to a nitriding treatment. Each of the powders had an average particle diameter of about 5 μm. Each of an aromatic polyamide resin (6 T nylon) and a polypropylene resin was hot-kneaded by using a Labo Plastomill in Ar at 300° C. (polyamide) and 250° C. (polypropylene), respectively, and was molded with a hot-pressing machine so as to produce a sample. A soluble polyimide resin and γ-butyrolactone as a solvent were mixed and agitated with a centrifugal deaerator for 5 minutes so as to produce a paste. Subsequently, a green sheet of 500 μm when completed was produced by a doctor blade method, and was dried and hot-pressed so as to produce a sample. An epoxy resin was agitated and mixed in a beaker, and was die-molded so as to produce a sample at appropriate cure conditions. All these samples had a resistivity of 0.1 Ω·cm or more.

This thin plate magnet was cut into the cross-sectional shape of the central leg of the ferrite core described below. The core was a common EE core made of MnZn ferrite material and having a magnetic path length of 5.9 cm and an effective cross-sectional area of 0.74 $cm^2$, and the central leg was processed to have a gap of 0.5 mm. The thin plate magnet produced as described above was inserted into the gap portion, and the arrangement was as shown in FIGS. 1A and 1B (reference numeral 43 denotes a thin plate magnet, reference numeral 45 denotes a ferrite core, and reference numeral 47 denotes coiled portions).

Subsequently, magnetization in the direction of the magnetic path with a pulse magnetizing apparatus was performed, and thereafter, regarding the direct current superimposition characteristic, an effective permeability was measured with a HP-4284A LCR meter manufactured by Hewlet Packerd under the conditions of an alternating current magnetic field frequency of 100 kHz and a direct current superimposed magnetic field of 35 Oe.

These cores were kept for 30 minutes in a reflow furnace at 270° C., and thereafter, the direct current superimposition characteristic was measured again under the same conditions.

As a comparative example, the measurement was carried out on a magnetic core with no magnet being inserted into the gap with the result that the characteristic did not changed between before and after the reflow, and the effective permeability $\mu e$ was 70.

Table 13 shows these results, and FIG. 7 shows direct current superimposition characteristics of Samples 2 and 4 and Comparative example as a part of the results. As a matter of course, superimposed direct current was applied in order that the direction of the direct current bias magnetic field was reverse to the direction of the magnetization of the magnet magnetized at the time of insertion.

Regarding the core with a thin plate magnet of polypropylene resin being inserted, the measurement could not be carried out due to remarkable deformation of the magnet.

Regarding the core with the Ba ferrite thin plate magnet having a coercive force of only 4 kOe being inserted, the direct current superimposition characteristic is degraded by a large degree after the reflow. The core with the $Sm_2Fe_{17}N$ thin plate magnet being inserted, the direct current superimposition characteristic is also degraded by a large degree after the reflow. On the contrary, regarding the core with the $Sm_2Co_{17}$ thin plate magnet having a coercive force of 10 kOe or more and a Tc of as high as 770° C. being inserted, degradation of the direct current superimposition characteristic is not observed and, therefore, very stable characteristics are exhibited.

From these results, the reason for the degradation of the direct current superimposition characteristic is assumed to be that since the Ba ferrite thin plate magnet has a mall coercive force, reduction of magnetization or inversion of magnetization is brought about by a magnetic field in the reverse direction applied to the thin plate magnet, and the reason for the degradation of the characteristics is assumed to be that although the SmFeN magnet has a high coercive force, the Tc is as low as 470° C. and, therefore, thermal demagnetization occurs, and the synergetic effect of the thermal demagnetization and the demagnetization caused by a magnetic field in the reverse direction is brought about. Therefore, regarding the thin plate magnet inserted into the core, superior direct current superimposition characteristics are exhibited when the thin plate magnet has a coercive force of 10 kOe or more and a Tc of 500° C. or more.

Although not shown in the present embodiment, the effects similar to those described above could be reliably achieved when the combinations were other than those in the present embodiment, and when thin plate magnets produced from other resins within the scope of the present invention were used.

TABLE 13

| sample | magnet composition<br>resin composition | iHc (kOe) | mixing ratio (weight part) | $\mu e$ before reflow (at 35 Oe) | $\mu e$ after reflow (at 35 Oe) |
|---|---|---|---|---|---|
| ① | $Sm(Co_{0.742}Fe_{0.20}Cu_{0.055}Zr_{0.029})_{7.7}$ | 15 | 100 | 140 | 130 |
| | aromatic polyamide resin | — | 100 | | |
| ② | $Sm(Co_{0.742}Fe_{0.20}Cu_{0.055}Zr_{0.029})_{7.7}$ | 15 | 100 | 120 | 120 |
| | soluble polyimide resin | — | 100 | | |
| ③ | $Sm(Co_{0.742}Fe_{0.20}Cu_{0.055}Zr_{0.029})_{7.7}$ | 15 | 100 | 140 | 120 |
| | epoxy resin | — | 100 | | |
| ④ | $Sm_2Fe_{17}N$ magnetpowder | 10 | 100 | 140 | 70 |
| | aromatic polyamide resin | — | 100 | | |
| ⑤ | Ba ferrite magnet powder | 4.0 | 100 | 90 | 70 |
| | aromatic polyamide resin | — | 100 | | |
| ⑥ | $Sm(Co_{0.742}Fe_{0.20}Cu_{0.055}Zr_{0.029})_{7.7}$ | 15 | 100 | 140 | — |
| | polypropylene resin | — | 100 | | |

EXAMPLE 15

The same $Sm_2Co_{17}$ magnetic powder (iHc=15 kOe) with that in Example 14 and a soluble poly(amide-imide) resin (TOYOBO VIROMAX) were kneaded with a pressure kneader, were diluted and kneaded with a planetary mixer, and were agitated with a centrifugal deaerator for 5 minutes so as to produce a paste. Subsequently, a green sheet of about 500 $\mu$m in thickness when dried was produced from the resulting paste by a doctor blade method, and was dried, hot-pressed, and processed to have a thickness of 0.5 mm and, therefore, a thin plate magnet sample was produced. Herein, the content of the poly(amide-imide) resin was adjusted as shown in Table 14 in order that the thin plate magnets had the resistivity of 0.06, 0.1, 0.2, 0.5, and 1.0 Ω·cm. Thereafter, these thin plate magnets were cut into the same cross-sectional shape with that of the central leg of the core in Example 8 so as to become samples.

Subsequently, each of the thin plate magnets produced as described above was inserted into the gap having a gap length of 0.5 mm of the same EE type core with that in Example 14, and the magnet was magnetized with a pulse magnetizing apparatus. Regarding the resulting core, a core loss characteristic was measured with a SY-8232 alternating current BH tracer manufactured by Iwatsu Electric Co., Ltd., under the conditions of 300 kHz and. 0.1 T at room temperature. Herein the same ferrite core was used in the measurements, and the core loss was measured after only the magnet was changed to other magnet having a different resistivity, and was inserted and magnetized again with the pulse magnetizing apparatus.

The results thereof are shown in Table 14. An EE core with the same gap had a core loss characteristic of 520 ($kW/m^3$) under the same conditions, as a comparative example.

As shown in Table 14, magnetic cores having a resistivity of 0.1 Ω·cm or more exhibited excellent core loss characteristics. The reason therefor is assumed to be that the eddy current loss can be alleviated by increasing the resistivity of the thin plate magnet.

TABLE 14

| sample | magnet composition | amount of resin (vol %) | resistivity (Ω · cm) | core loss (kW/m³) |
|---|---|---|---|---|
| 1 | $Sm(Co_{0.742}Fe_{0.20}Cu_{0.055}Zr_{0.029})_{7.7}$ | 25 | 0.06 | 1250 |
| 2 | | 30 | 0.1 | 680 |
| 3 | | 35 | 0.2 | 600 |
| 4 | | 40 | 0.5 | 530 |
| 5 | | 50 | 1.0 | 540 |

As described above, the thin plate magnet of 500 μm or less can be produced according to the present embodiment. By using this thin plate magnet as a magnetic bias magnet, a miniaturized magnetic core can be provided, and this magnetic core has improved direct current superimposition characteristics at high frequencies and has characteristics with no degradation even at a reflow temperature. Furthermore, by using this magnetic core, an inductor element having characteristics with no degradation due to reflow and having a capability of surface mounting can be provided.

EXAMPLE 16

Magnet powders having different average particle diameters were prepared from a sintered magnet (iHc=15 kOe) having a composition $Sm(Co_{0.742}Fe_{0.20}Cu_{0.055}Zr_{0.0029})_{7.7}$ by changing pulverization times, and thereafter maximum particle diameters were adjusted through sieves having different meshes.

A $Sm_2Co_{17}$ magnet powder, RIKACOAT (polyimide resin) manufactured by New Japan Chemical Co., Ltd., and γ-butyrolactone as a solvent were mixed and agitated with a centrifugal deaerator for 5 minutes and, therefore, paste was produced. If the paste was dried, the composition became 60 vol % of $Sm_2Co_{17}$ magnet powder and 40 vol % of polyimide resin. The blending ratio of the solvent, γ-butyrolactone, was specified to be 10 parts by weight relative to the total of the $Sm_2Co_{17}$ magnet powder and RiKACOAT manufactured by New Japan Chemical Co., Ltd., of 70 parts by weight. A green sheet of 500 μm was produced from the resulting paste by a doctor blade method, and drying and hot-pressing were performed. The resulting sheet was cut into the shape of the central leg of the ferrite core, and was magnetized with a pulse magnetizing apparatus at 4 T and, therefore, a thin plate magnet were produced. The flux of each of these thin plate magnets was measured with a TOEI TDF-5 Digital Flux meter and the measurement results are shown in Table 15. Furthermore, the thin plate magnet was inserted into the ferrite core in a manner similar to that in Example 14, and direct current superimposition characteristic was measured, and subsequently, the quantity of bias was measured. The quantity of bias was determined as a product of magnetic permeability and superimposed magnetic field.

TABLE 15

| sample | average particle diameter (μm) | mesh of sieve (μm) | press pressure upon hot press (kgf/cm²) | center line average roughness (μm) | amount of flux (G) | bias amount (G) |
|---|---|---|---|---|---|---|
| 1 | 2.1 | 45 | 200 | 1.7 | 30 | 600 |
| 2 | 2.5 | 45 | 200 | 2 | 130 | 2500 |
| 3 | 5.4 | 45 | 200 | 6 | 110 | 2150 |
| 4 | 25 | 45 | 200 | 20 | 90 | 1200 |
| 5 | 5.2 | 45 | 100 | 12 | 60 | 1100 |
| 6 | 5.5 | 90 | 200 | 15 | 100 | 1400 |

Regarding Sample 1 having an average particle diameter of 2.1 μm, the flux is reduced and the quantity of bias is small. The reason for this is believed to be that oxidation of the magnet powder proceeds during production steps. Regarding Sample 4 having a large average particle diameter, the flux is reduced due to a low filling factor of the powder, and the quantity of bias is reduced. The reason for the reduction of the quantity of bias is believed to be that since the surface roughness of the magnet is coarse, adhesion with the core is insufficient and, therefore, permeance coefficient is reduced. Regarding Sample 5 having a small particle diameter, but having a large surface roughness due to an insufficient pressure during the press, the flux is reduced due to a low filling factor of the powder, and the quantity of bias is reduced. Regarding Sample 6 containing coarse particles, the quantity of bias is reduced. The reason for this is believed to be that the surface roughness is coarse.

As is clear from these results, superior direct current superimposition characteristics are exhibited when an inserted thin plate magnet has an average particle diameter of the magnet powder of 25 μm or more, the maximum particle diameter of 50 μm or more, and a center line average roughness of 10 μm or less.

EXAMPLE 17

Two magnet powders, each produced by rough pulverization of an ingot and subsequent heat treatment, were used. One ingot was a $Sm_2Co_{17}$-based ingot having a Zr content of 0.01 atomic percent and having a composition of so-called second-generation $Sm_2Co_{17}$ magnet, $Sm(Co_{0.78}Fe_{0.11}Cu_{0.10}Zr_{0.01})_{8.2}$, and the other ingot was a $Sm_2Co_{17}$-based ingot having a Zr content of 0.029 atomic percent and having a composition of so-called third-generation $Sm_2Co_{17}$ magnet $Sm(Co_{0.0742}Fe_{0.20}Cu_{0.055}Zr_{0.029})_{8.2}$. The aforementioned second-generation $Sm_2Co_{17}$ magnet powder was subjected to an age heat treatment at 800° C. for 1.5 hours, and the third-generation $Sm_2Co_{17}$ magnet powder was subjected to an age heat treatment at 800° C. for 10 hours. By these treatments, coercive forces measured by VSM were 8 kOe and 20 kOe regarding the second-generation $Sm_2Co_{17}$ magnet powder and the third-generation $Sm_2Co_{17}$ magnet powder, respectively. These roughly pulverized powders were finely pulverized in an organic solvent with a ball mill in order to have an average particle diameter of 5.2 μm, and the resulting powders were passed through a sieve having openings of 45 μm and, therefore, magnet powders were produced. Each of the resulting magnet powders was mixed with 35 vol % of epoxy resin, and the mixture was die-molded into a bonded magnet having a shape of the central leg of the same EE core with that in Example 14 and a thickness of 0.5 mm. The magnet characteristics were measured using a separately prepared test piece having a diameter of 10 and a thickness of 10 with a direct current BH tracer.

The coercive forces were nearly equivalent to those of the roughly pulverized powder. Subsequently, these magnets were inserted into the same EE core with that in Example 14, and pulse magnetization and application of coil were performed. Then, the effective permeability was measured with a LCR meter under the conditions of a direct current superimposed magnetic field of 40 Oe and 100 kHz. These cores were kept under the same conditions with those in the reflow, that is, these cores were kept in a thermostatic chamber at 270° C. for 1 hour, and thereafter, the direct current superimposition characteristics were measured in a manner similar to that in the above description. The results thereof are also shown in Table 16.

TABLE 16

| Sample | $\mu e$ before reflow (at 35 Oe) | $\mu e$ before reflow (at 35 Oe) |
|---|---|---|
| $Sm(Co_{0.78}Fe_{0.11}Cu_{0.10}Zr_{0.01})_{8.2}$ | 120 | 40 |
| $Sm(Co_{0.742}Fe_{0.20}Cu_{0.055}Zr_{0.029})_{8.2}$ | 130 | 130 |

As is clear from Table 16, when the third-generation $Sm_2Co_{17}$ magnet powder having a high coercive force is used, excellent direct current superimposition characteristics can also be achieved even after the reflow. The presence of a peak of the coercive force is generally observed at a specific ratio of Sm and transition metals, although the optimum compositional ratio varies depending on the oxygen content in the alloy as is generally known. Regarding the sintered material, the optimum compositional ratio is verified to vary within 7.0 to 8.0, and regarding the ingot, the optimum compositional ratio is verified to vary within 8.0 to 8.5. As is clear from above description, excellent direct current superimposition characteristics are exhibited even under reflow conditions when the composition is the third-generation $Sm(Co_{bal}Fe_{0.15\ to\ 0.25}Cu_{0.05\ to\ 0.06}Zr_{0.02\ to\ 0.03})_{7.0\ to\ 8.5}$.

EXAMPLE 18

Figure 17:
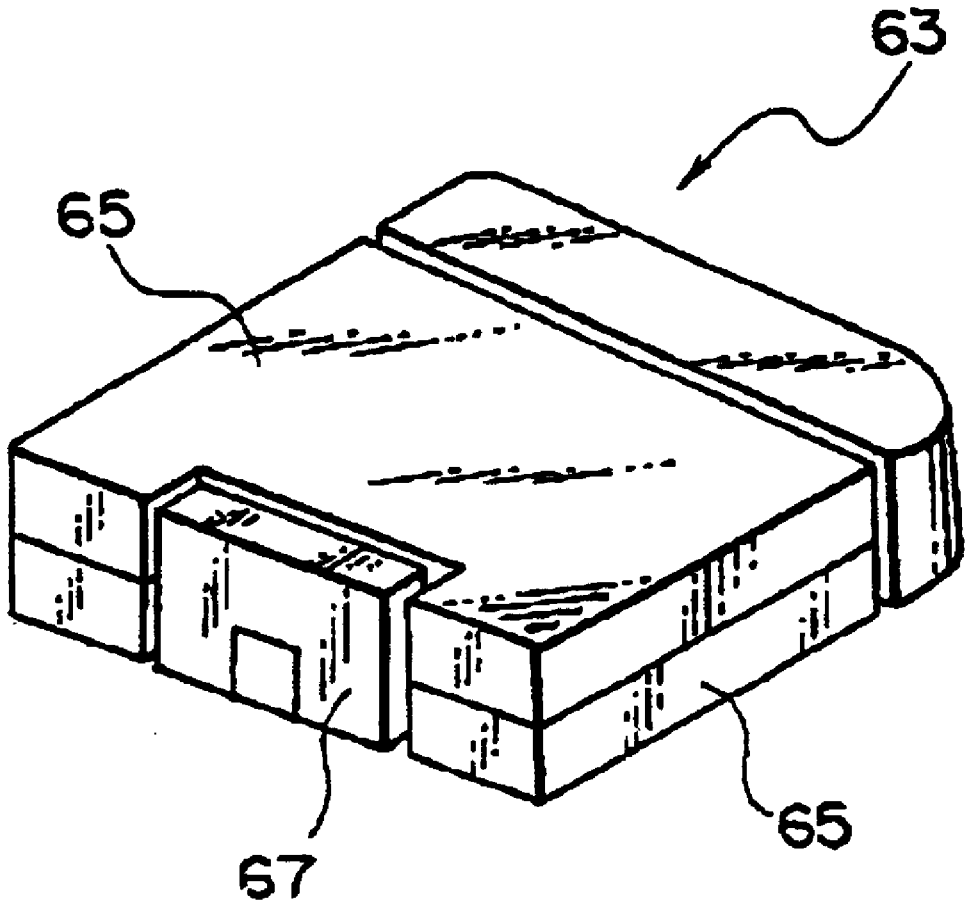
FIG. 17 is a perspective external view of an inductor component including a thin plate magnet according to Example 21 of the present invention.

The magnet powder produced in Sample 3 of Example 16 was used. This magnet powder had a composition $Sm(Co_{0.742}Fe_{0.20}Cu_{0.055}Zr_{0.029})_{7.7}$, an average particle diameter of 5 $\mu$m, and a maximum particle diameter of 45 $\mu$m. The surface of each of the magnet powders was coated with Zn, inorganic glass ($ZnO—B_2O_3—PbO$) having a softening point of 400° C., or Zn and furthermore inorganic glass ($ZnO—B_2O_3—PbO$). Tha thin plate magnet was produced in the same manner with that of Sample 2 of Example 2, the resulting thin plate magnet was inserted into the Mn—Zn ferrite core, and the direct current superimposition characteristic of the resulting Mn—Zn ferrite core was measured in the same manner with that in Example 16. Thereafter the quantity of bias was determined and the core loss characteristic was measured in the same manner with that in Example 2. The results of the comparison are shown in FIG. 17.

Herein, Zn was mixed with the magnet powder, and thereafter, a heat treatment was performed at 500° C. in an Ar atmosphere for 2 hours. $ZnO—B_2O_3—PbO$ was heat-treated in the same manner with that of Zn except that the heat treatment temperature was 450° C. On the other hand, in order to form a composite layer, Zn and the magnet powder were mixed and were heat-treated at 500° C., the resulting powder was taken out of the furnace, and the powder and the $ZnO—B_2O_3—PbO$ powder were mixed, and thereafter, the resulting mixture was heat-treated at 450° C. The resulting powder was mixed with a binder (epoxy resin) in an amount of 45 vol % of the total volume, and thereafter, die-molding was performed without magnetic field. The resulting molding had the shape of the cross-section of the central leg of the same ferrite core with that in Example 15 and had a height of 0.5 mm. The resulting molding was inserted into the core, and magnetization was performed with a pulse magnetic field of about 10 T. The direct current superimposition characteristic was measured in the same manner with that in Example 14, and the core loss characteristic was measured in the same manner with that in Example 15. Then, these cores were kept in a thermostatic chamber at 270° C. for 30 minutes, and thereafter, the direct current superimposition characteristic and core loss characteristic were measured similarly to the above description. As a comparative example, a molding was produced from the powder with no coating in the same manner with that described above, and characteristics were measured. The results are also shown in Table 17.

As is clear from the results, although regarding the uncoated sample, the direct current superimposition characteristic and core loss characteristic are degraded by a large degree due to the heat treatment, regarding the samples coated with Zn, inorganic glass, and a composite thereof, rate of the degradation during the heat treatment is very small compared to that of the uncoated sample. The reason therefor is assumed to be that oxidation of the magnet powder is prevented by the coating.

Regarding the samples containing 10 vol % or more of coating materials, the effective permeability is low, and the strength of the bias magnetic field due to the magnet is reduced by a large degree compared to those of other samples. The reason therefor is believed to be that the content of the magnet powder is reduced due to increase in amount of the coating material, or magnetization is reduced due to reaction of the magnet powder and the coating materials. Therefore, especially superior characteristics are exhibited when the amount of the coating material is within the range of 0.1 to 10 wt %.

TABLE 17

| | coating layer | | | before reflow | | after reflow | |
|---|---|---|---|---|---|---|---|
| Sample | Zn (vol %) | $B_2O_3$ – PbO (vol %) | Zn + $B_2O_3$ – PbO (vol %) | bias amount (G) | core loss (kW/m$^3$) | bias amount (G) | core loss (kW/m$^3$) |
| comparative example | — | — | — | 2200 | 520 | 300 | 1020 |

TABLE 17-continued

| | coating layer | | | before reflow | | after reflow | |
|---|---|---|---|---|---|---|---|
| Sample | Zn (vol %) | $B_2O_3$ – PbO (vol %) | Zn + $B_2O_3$ – PbO (vol %) | bias amount (G) | core loss ($kW/m^3$) | bias amount (G) | core loss ($kW/m^3$) |
| 1 | 0.1 | | | 2180 | 530 | 2010 | 620 |
| 2 | 1.0 | | | 2150 | 550 | 2050 | 600 |
| 3 | 3.0 | | | 2130 | 570 | 2100 | 580 |
| 4 | 5.0 | | | 2100 | 590 | 2080 | 610 |
| 5 | 10.0 | | | 2000 | 650 | 1980 | 690 |
| 6 | 15.0 | | | 1480 | 1310 | 1480 | 1350 |
| 7 | | 0.1 | | 2150 | 540 | 1980 | 610 |
| 8 | | 1.0 | | 2080 | 530 | 1990 | 590 |
| 9 | | 3.0 | | 2050 | 550 | 2020 | 540 |
| 10 | | 5.0 | | 2020 | 570 | 2000 | 550 |
| 11 | | 10.0 | | 1900 | 560 | 1880 | 570 |
| 12 | | 15.0 | | 1250 | 530 | 1180 | 540 |
| 13 | | | 3 + 2 | 2050 | 560 | 2030 | 550 |
| 14 | | | 5 + 5 | 2080 | 550 | 2050 | 560 |
| 15 | | | 10 + 5 | 1330 | 570 | 1280 | 580 |

EXAMPLE 19

The $Sm_2Co_{17}$ magnet powder of Sample 3 in Example 16 was mixed with 50 vol % of epoxy resin as a binder, and the resulting mixture was die-molded in the direction of top and bottom of the central leg in a magnetic field of 2 T so as to produce an anisotropic magnet. As a comparative example, a magnet was also produced by die-molding without magnetic field. Thereafter, each of these bonded magnets was inserted into a MnZn ferrite material in a manner similar to that in Example 15, and pulse magnetization and application of coil were performed. Then, the direct current superimposition characteristic was measured with a LCR meter, and the magnetic permeability was calculated from the core constants and the number of turns of coil. The results thereof are shown in Table 18.

After the measurements were completed, the samples were kept under the same conditions with those in the reflow, that is, the samples were kept in a thermostatic chamber at 270° C. for 1 hour. Thereafter, the samples were cooled to ambient temperature and the direct current superimposition characteristics were measured in a manner similar to that in the above description. The results thereof are also shown in Table 18.

As is clear from Table 18, excellent direct current superimposition characteristics are exhibited both before and after the reflow compared to that of magnets molded without magnetic field.

TABLE 18

| sample | $\mu e$ before reflow (at 45 Oe) | $\mu e$ after reflow (at 45 Oe) |
|---|---|---|
| molded within magnetic field | 130 | 130 |
| molded without magnetic field | 50 | 50 |

EXAMPLE 20

The $Sm_2Co_{17}$ magnet powder of Sample 3 in Example 16 was mixed with 50 vol % of epoxy resin as a binder, and the resulting mixture was die-molded without magnetic field so as to produce a magnet having a thickness of 0.5 mm. The resulting magnet was inserted into a MnZn ferrite material, and magnetization was performed in a manner similar to that in Example 14. At that time, the magnetic fields for magnetization were 1, 2, 2.5, 3, 5, and 10 T. Regarding 1, 2, and 2.5 T. magnetization was performed with an electromagnet, and regarding 3, 5, and 10 T. magnetization was performed with a pulse magnetizing apparatus. Subsequently, the direct current superimposition characteristic was measured with a LCR meter, and the magnetic permeability was calculated from the core constants and the number of turns of coil. From these results, the quantity of bias was determined by the method used in Example 16, and the results thereof are shown in FIG. 16.

Figure 16:
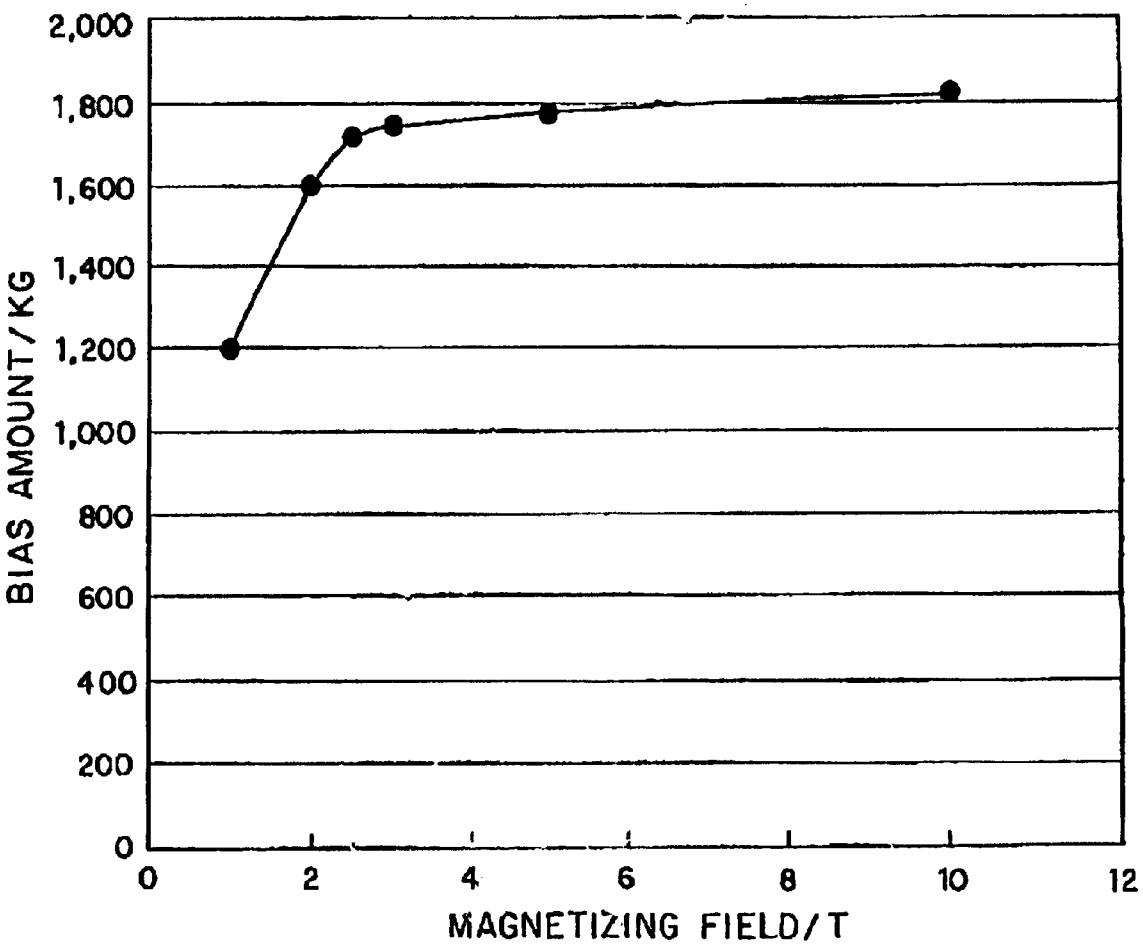
FIG. 16 is a graph showing magnetizing magnetic fields and the direct current superimposition characteristic of a $Sm_2Co_{17}$ magnet-epoxy resin thin plate magnet in Example 20.

As is clear from FIG. 16, when the magnetic field is less than 2.5 T, excellent superimposition characteristics cannot be achieved.

EXAMPLE 21

Figure 18:
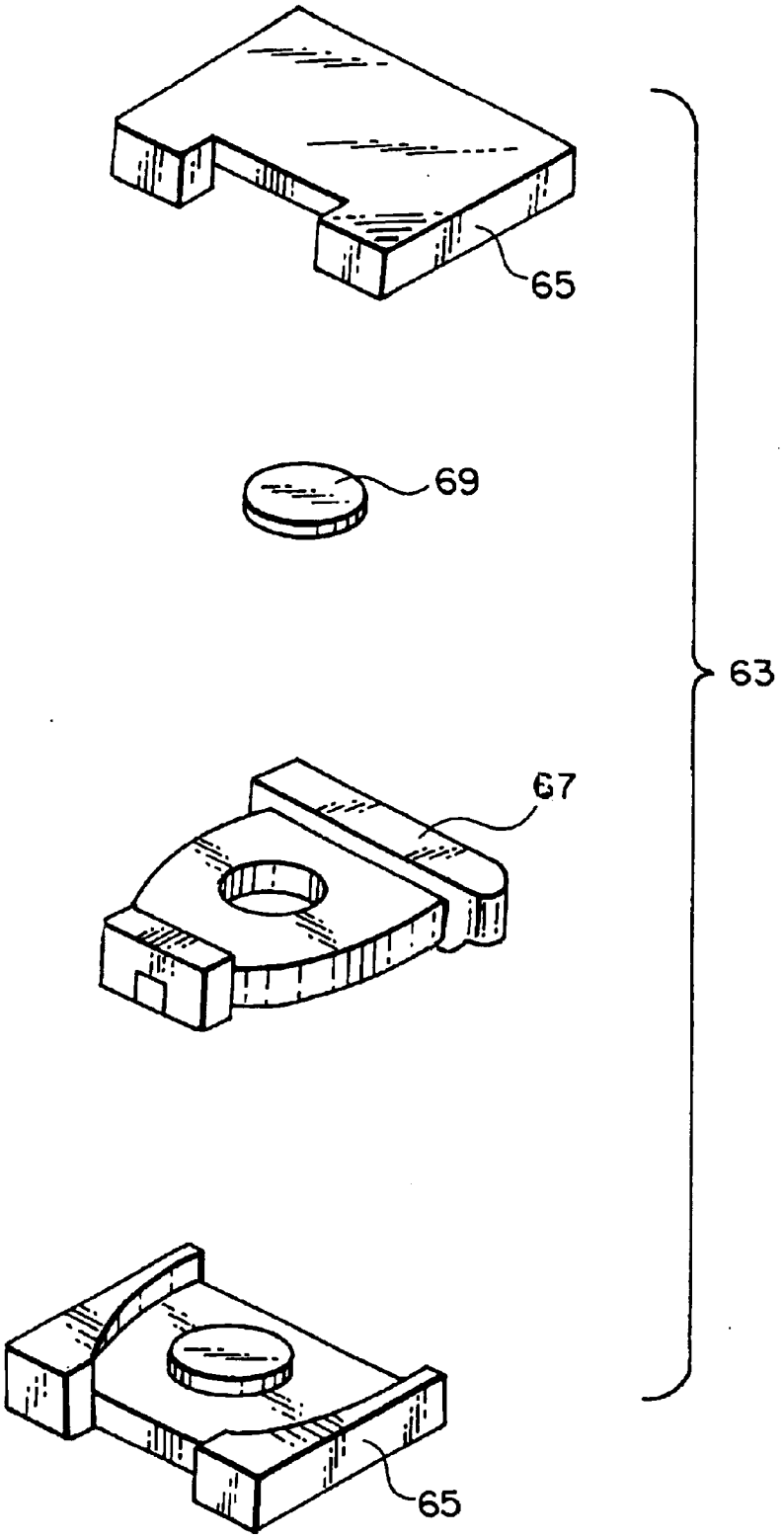
FIG. 18 is a perspective exploded view of the inductor component shown in FIG. 17.

An inductor component according to the present invention will now be described below with reference to FIGS. 17 and 18. A core 65 used in an inductor component is made of a MnZn ferrite material and constitutes an EE type magnetic core having a magnetic path length of 2.46 cm and an effective cross-sectional area of 0.394 $cm^2$. The thin plate magnet 69 having a thickness of 0.16 mm is processed into the same shape with the cross-section of the central leg of the E type core 65. As shown in FIG. 18, a molded coil (resin-sealed coil (number of turns of 4 turns)) 67 is incorporated in the E type core 65, the thin plate magnet 69 is arranged in a core gap portion, and is held by the other core 65 and, therefore, this assembly functions as an inductor component.

The direction of the magnetization of the thin plate magnet 69 is specified to be reverse to the direction of the magnetic field made by the molded coil.

Figure 19:
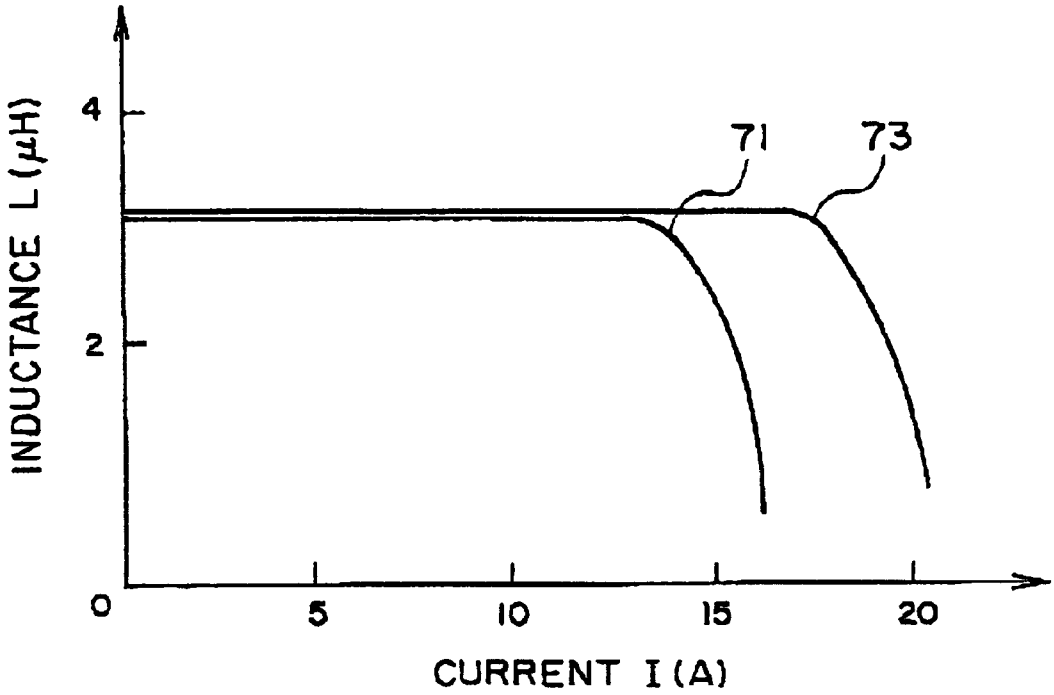
FIG. 19 is a graph showing the direct current superimposed inductance characteristic of the inductor component shown in FIG. 17.

The direct current superimposed inductance characteristics were measured regarding the case where the thin plate magnet was applied and the case where the thin plate magnet was not applied for purposes of comparison, and the results are indicated by 73, the former, and 71, the latter, in FIG. 19.

The direct current superimposed inductance characteristic was measured after passing through a reflow furnace (peak temperature of 270° C.) similarly to the above description.

As a result, the direct current superimposed inductance characteristic after the reflow was verified to be equivalent to that before the reflow.

EXAMPLE 22

Figure 20:
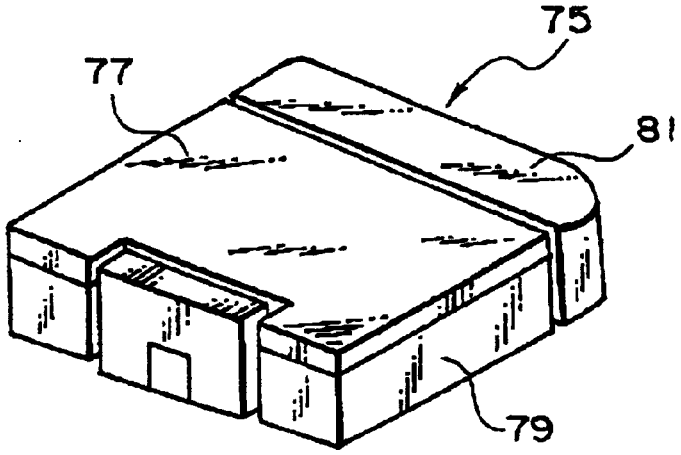
FIG. 20 is a perspective external view of an inductor component including a thin plate magnet according to Example 22 of the present invention.
Figure 21:
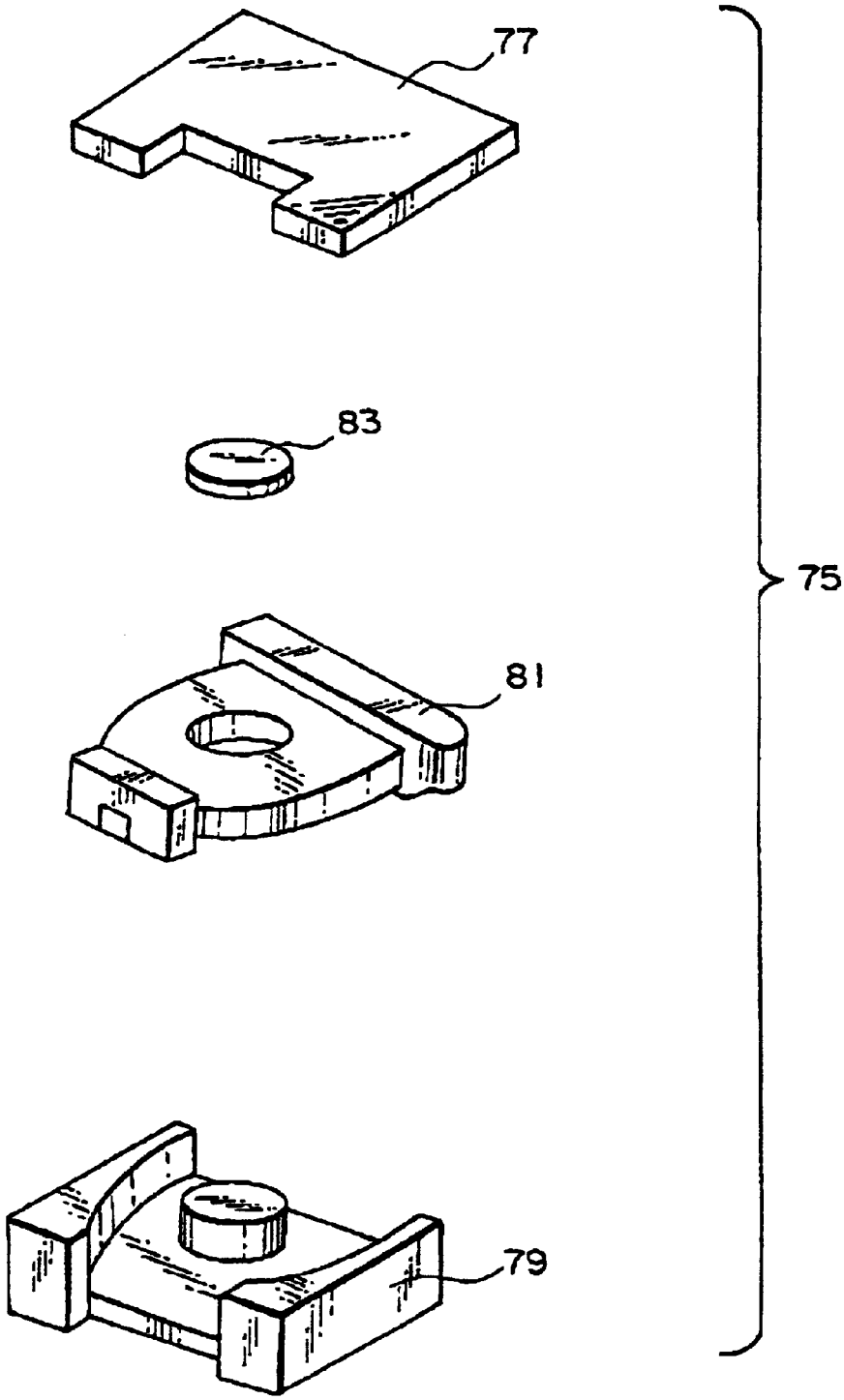
FIG. 21 is a perspective exploded view of the inductor component shown in FIG. 20.

Another inductor component according to the present invention will now be described below with reference to FIGS. 20 and 21. A core used in the inductor component is made of a MnZn ferrite material and constitutes a magnetic core having a magnetic path length of 2.46 cm and an effective cross-sectional area of 0.394 $cm^2$ in a manner similar to Example 21. However, an EI type magnetic core is formed and functions as an inductor component. The steps for assembling are similar to those in Example 21, although the shape of one ferrite core 77 is I type.

The direct current superimposed inductance characteristics are equivalent to those in Example 21 regarding the core with the thin plate magnet being applied and the core after passing through a reflow furnace.

EXAMPLE 23

Figure 22:
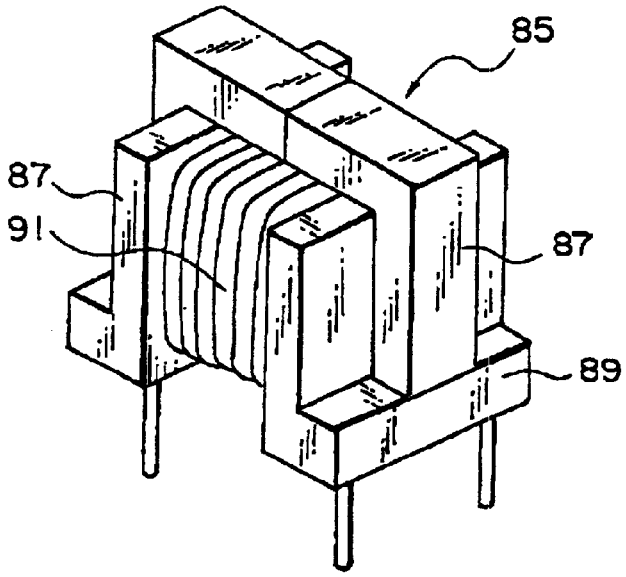
FIG. 22 is a perspective external view of an inductor component including a thin plate magnet according to Example 23 of the present invention.
Figure 23:
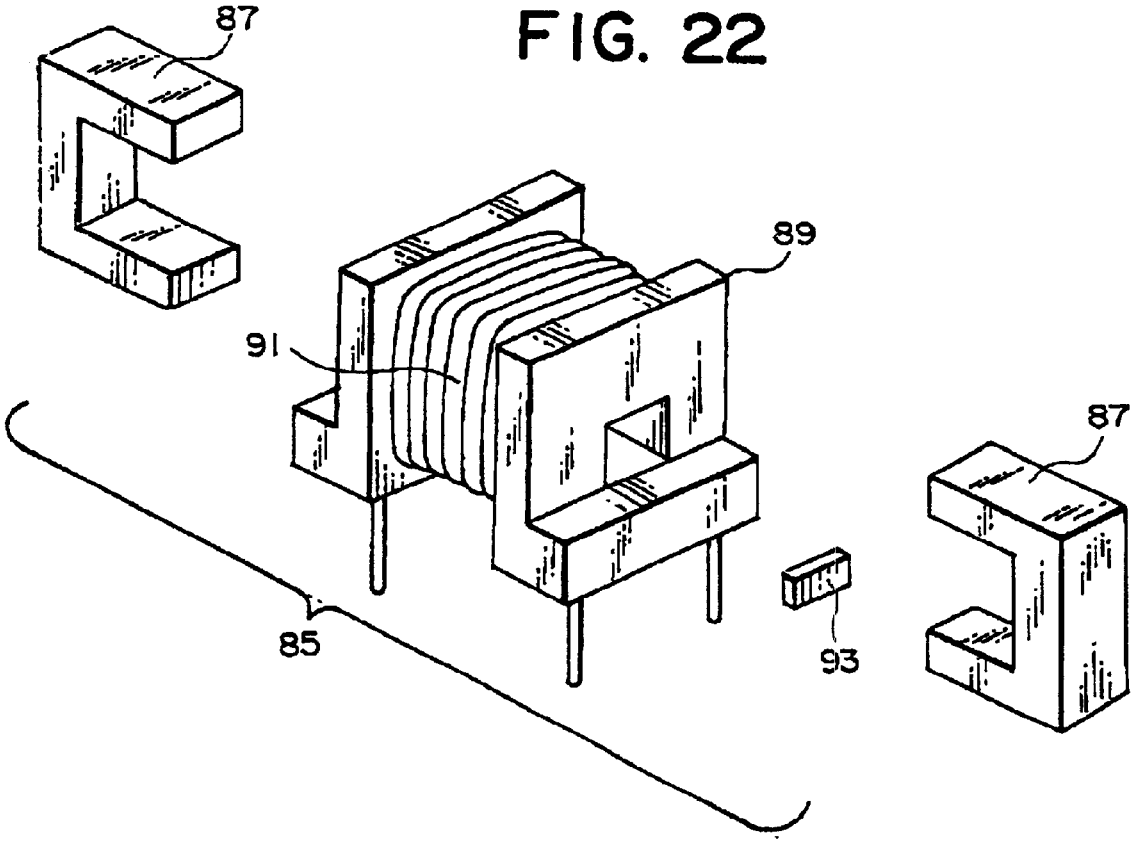
FIG. 23 is a perspective exploded view of the inductor component shown in FIG. 22.

Another inductor component according to the present invention will now be described below with reference to FIGS. 22 and 23. A thin plate magnet according to Example 23 of the present invention is applied to the inductor component. A core 87 used in the inductor component is made of a MnZn ferrite material and constitutes a UU type magnetic core having a magnetic path length of 0.02 m and an effective cross-sectional area of $5\times10^{-6}$ $m^2$. As shown in FIG. 23, a coil 91 is applied to a bobbin 89, and a thin plate magnet 93 is arranged in a gap portion when a pair of U type cores 87 are incorporated. The thin plate magnet 93 has been processed into the same shape of the cross-section (joint portion) of the U type core 87, and has a thickness of 0.2 mm. This assembly functions as an inductor component having a permeability of $4\times10^{-3}$ H/m.

The direction of the magnetization of the thin plate magnet 93 is specified to be reverse to the direction of the magnetic field made by the coil.

Figure 24:
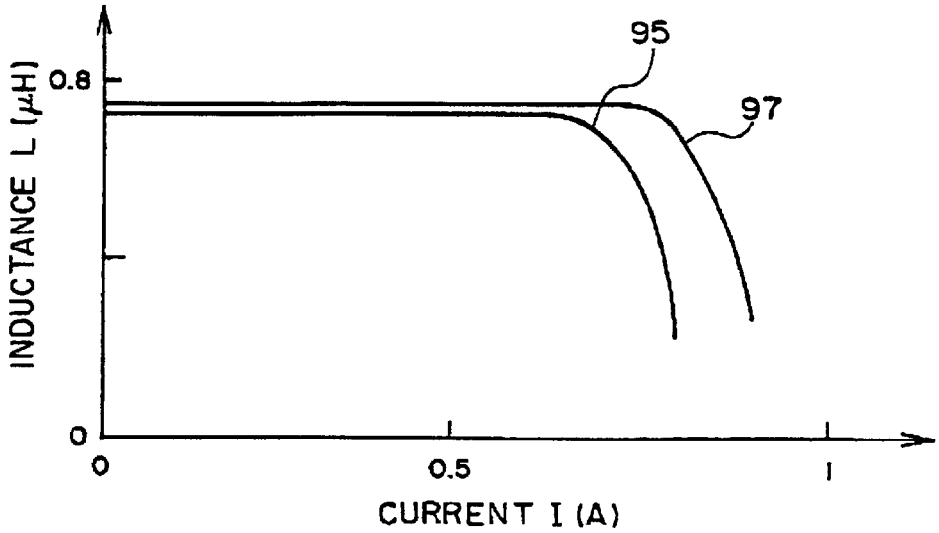
FIG. 24 is a graph showing the direct current superimposed inductance characteristic of the inductor component shown in FIG. 22.

The direct current superimposed inductance characteristics were measured regarding the case where the thin plate magnet was applied and, for purposes of comparison, the case where the thin plate magnet was not applied. The results are indicated by 97, the former, and 95, the latter, in FIG. 24.

Figure 25A:
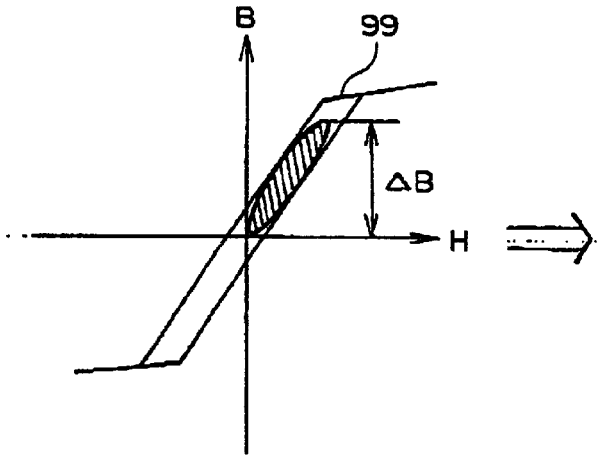
FIG. 25A is a drawing for explaining a working region of a conventional inductor component.
Figure 25B:
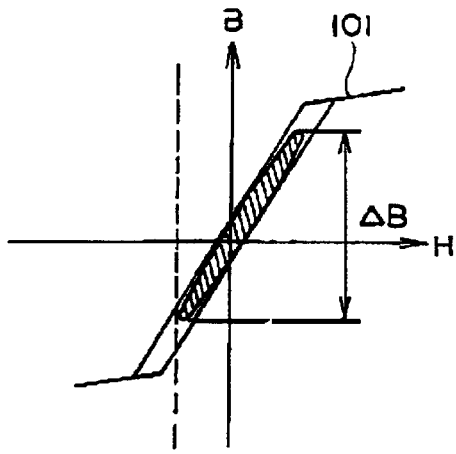
FIG. 25B is a drawing for explaining a working region of the inductor component shown in FIG. 22.

The results of the aforementioned direct current superimposed inductance characteristics are generally equivalent to enlargement of working magnetic flux density (ΔB) of the core constituting the magnetic core, and this is supplementally described below with reference to FIGS. 25A and 25B. In FIG. 25A, 99 indicates a working range of the core relative to a conventional inductor component, and 101 in FIG. 25B indicates a working range of the core relative to the inductor component with the thin plate magnet according to the present invention being applied. Regarding these drawings, 99 and 101 correspond to 95 and 97, respectively, in the aforementioned results of the direct current superimposed inductance characteristics. In general, inductor components are represented by the following theoretical equation (1).

$$\Delta B=(E\cdot \mathrm{ton})/(N\cdot Ae) \quad (1)$$

wherein E denotes applied voltage of inductor component, ton denotes voltage application time, N denotes the number of turns of inductor, and Ae denotes effective cross-sectional area of core constituting magnetic core.

As is clear from this equation (1), an effect of the aforementioned enlargement of the working magnetic flux density (ΔB) is proportionate to the reciprocal of the number of turns N and the reciprocal of the effective cross-sectional area Ae, while the former brings about an effect of reducing the copper loss and miniaturization of the inductor component due to reduction of the number of turns of the inductor component, and the latter contributes to miniaturization of the core constituting the magnetic core and, therefore, contributes to miniaturization of the inductor component by a large degree in combination with the aforementioned miniaturization due to the reduction of the number of turns. Regarding the transformer, since the number of turns of the primary and secondary coils can be reduced, an enormous effect is exhibited.

Furthermore, the output power is represented by the equation (2). As is clear from the equation, the effect of enlarging working magnetic flux density (ΔB) affects an effect of increasing output power.

$$Po=\kappa\cdot(\Delta B)^2\cdot f \quad (2)$$

wherein Po denotes inductor output power, κ denotes proportionality constant, and f denotes driving frequency.

Regarding the reliability of the inductor component, the direct current superimposed inductance characteristic was measured after passing through a reflow furnace (peak temperature of 270° C.) similarly to the above description. As a result, the direct current superimposed inductance characteristic after the reflow was verified to be equivalent to that before the reflow.

EXAMPLE 24

Figure 26:
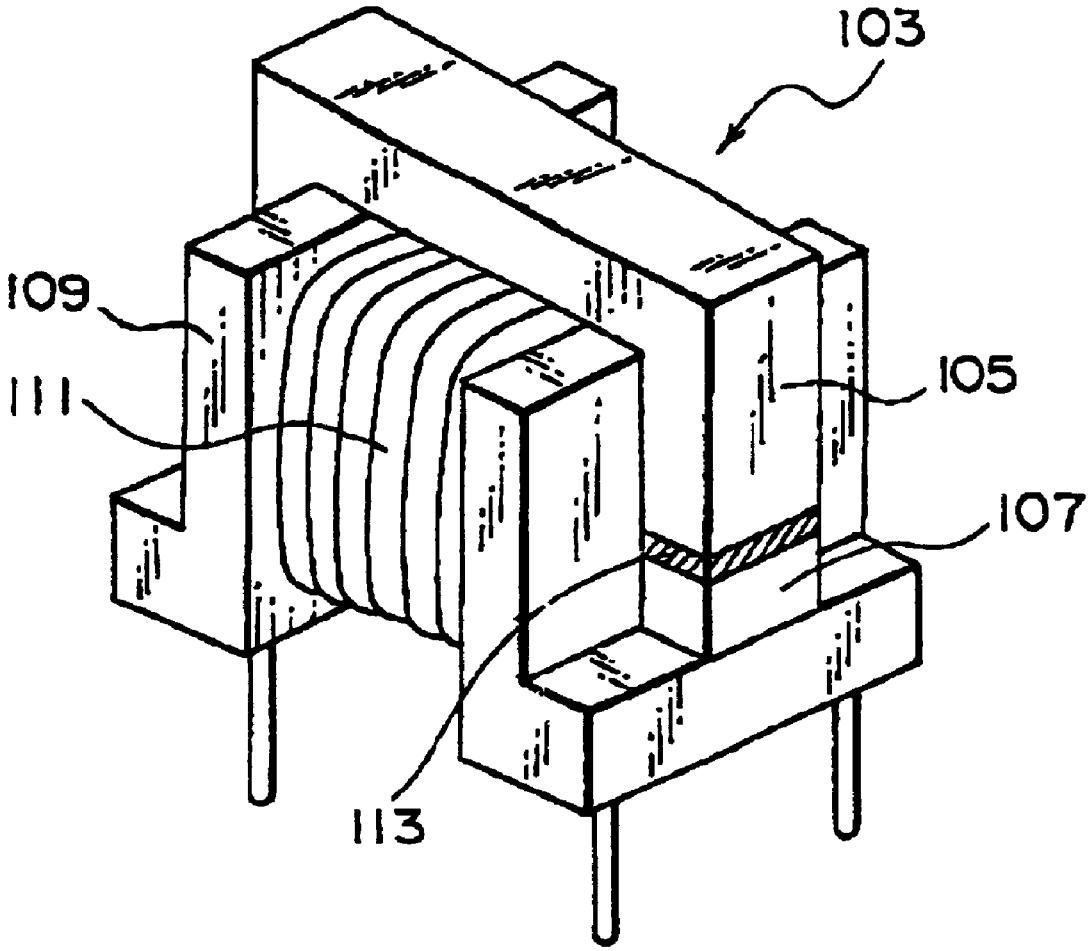
FIG. 26 is a perspective external view of an embodiment of an inductor component including a thin plate magnet according to Example 24 of the present invention.
Figure 27:
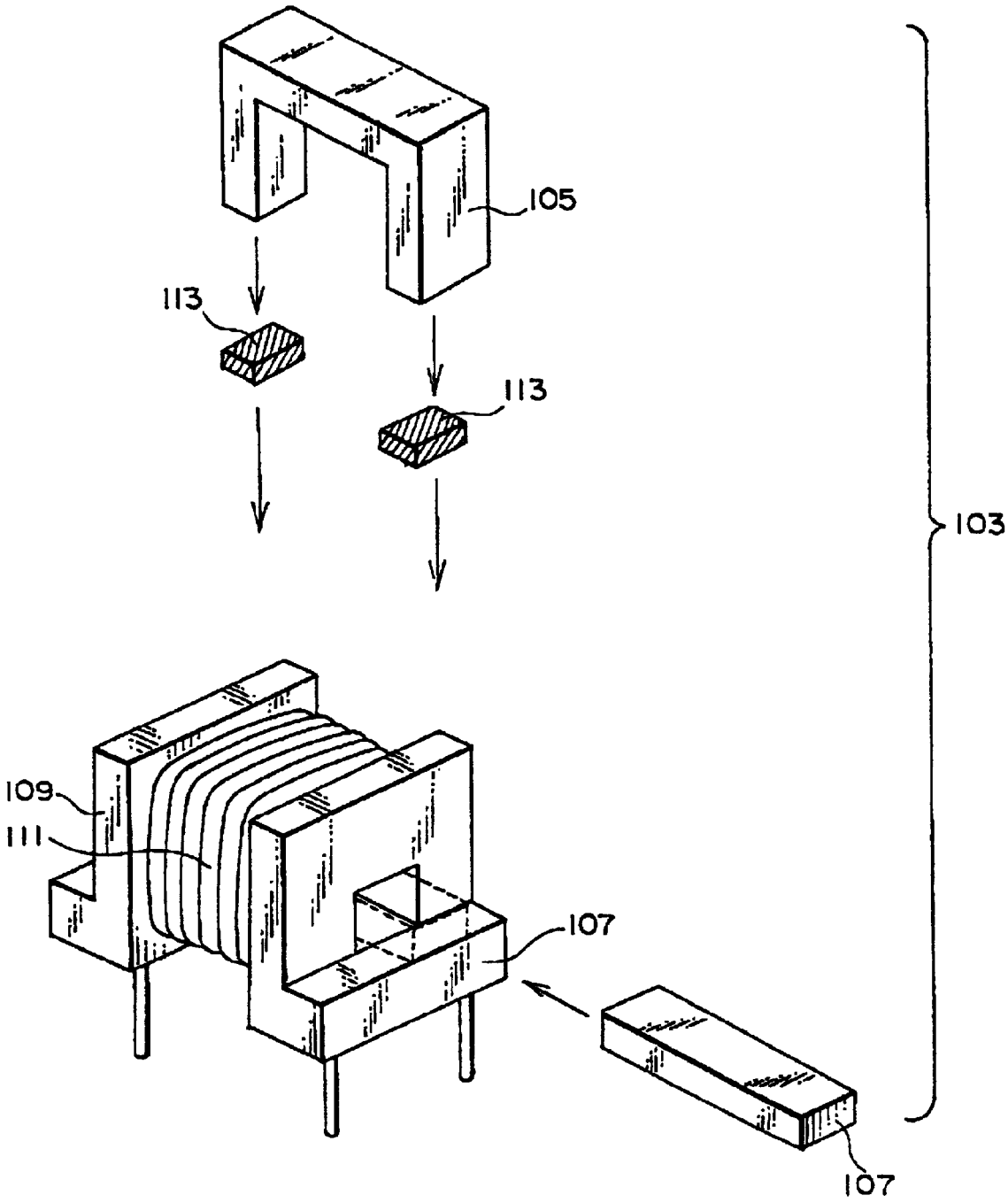
FIG. 27 is a perspective exploded view of the inductor component shown in FIG. 26.

Another inductor component according to the present invention will now be described below with reference to FIGS. 26 and 27. A thin plate magnet according to Example 24 of the present invention is applied to the inductor component. A core used in the inductor component is made of a MnZn ferrite material and constitutes a magnetic core having a magnetic path length of 0.02 m and an effective cross-sectional area of $5\times10^{-6}$ $m^{-2}$ in a manner similar to Example 23, or constitutes a UI type magnetic core and, therefore, functions as the inductor component. As shown in FIG. 27, a coil 109 is applied to a bobbin 71, and an I type core 107 is incorporated in the bobbin. Subsequently, thin plate magnets 113 are arranged on both flange portions of the coiled bobbin (on the portions of the I type core 107 extending off the bobbin) on a one-by-one basis (total two magnets for both flanges), and a U type core 105 is incorporated and, therefore, the inductor component is completed. The thin plate magnets 113 have been processed into the same shape of the cross-section point portion) of the U type core 105, and have a thickness of 0.1 mm.

The direct current superimposed inductance characteristics are equivalent to those in Example 23 regarding the core with the thin plate magnet being applied and the core after passing through a reflow furnace.

EXAMPLE 25

Figure 28:
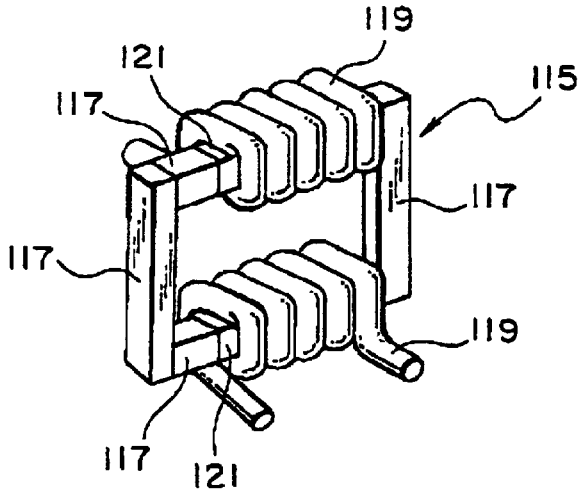
FIG. 28 is a perspective external view of an inductor component including a thin plate magnet according to Example 25 of the present invention.
Figure 29:
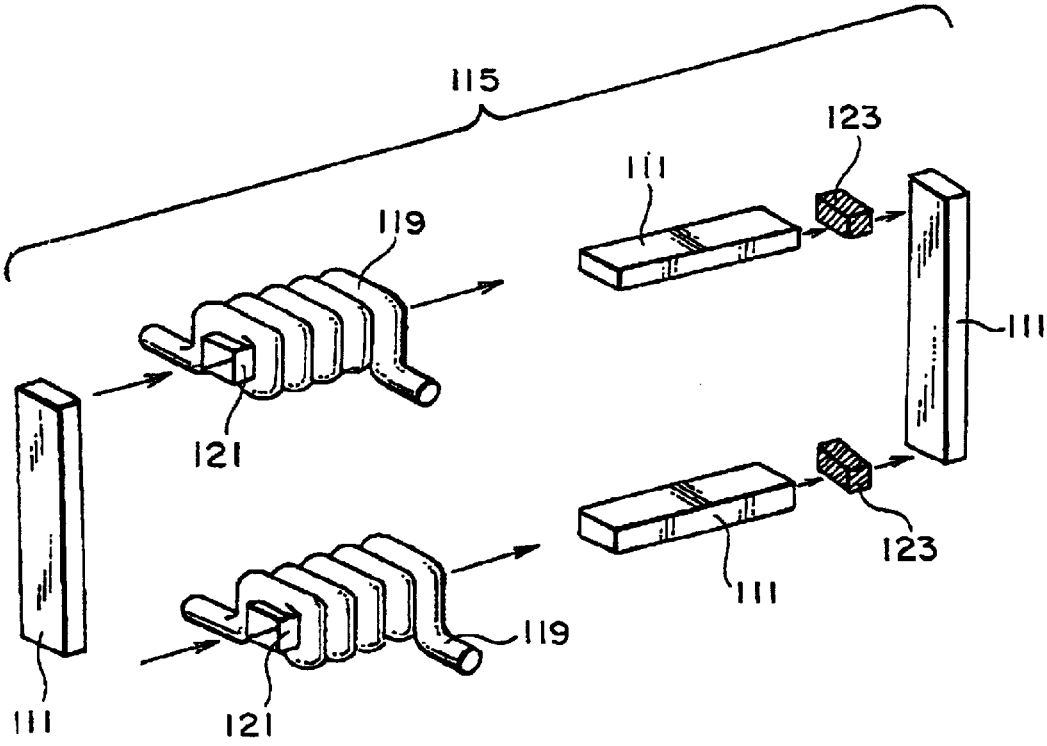
FIG. 29 is a perspective exploded view of the inductor component shown in FIG. 28.

Another inductor component according to the present invention will now be described below with reference to FIGS. 28 and 29. A thin plate magnet according to Example 25 of the present invention is applied to the inductor component. Four I type cores 117 used in the inductor component are made of silicon steel and constitutes a square type magnetic core having a magnetic path length of 0.2 m and an effective cross-sectional area of $1\times10^{-4}$ $m^2$. As shown in FIG. 28, I type cores 117 are inserted into two coils 119 having insulating paper on a one-by-one basis, and another two I type cores 117 are incorporated in order to form a square type magnetic path. Magnetic cores 123 according to the present invention are arranged at the joint portion thereof and, therefore, the square type magnetic path having a permeability of $2\times10^{-2}$ H/m is formed and functions as the inductor component.

The direction of the magnetization of the thin plate magnet 123 is specified to be reverse to the direction of the magnetic field made by the coil.

Figure 30:
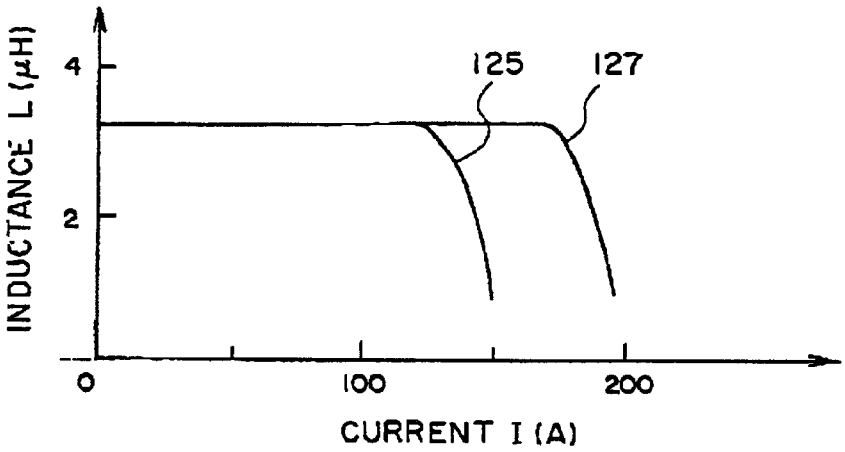
FIG. 30 is a graph showing the direct current superimposed inductance characteristic of the inductor component shown in FIG. 28.

The direct current superimposed inductance characteristics were measured regarding the case where the thin plate magnet was applied and, for purposes of comparison, where the thin plate magnet was not applied. The results are indicated by 127, the former, and 125, the latter, in FIG. 30.

Figure 31A:
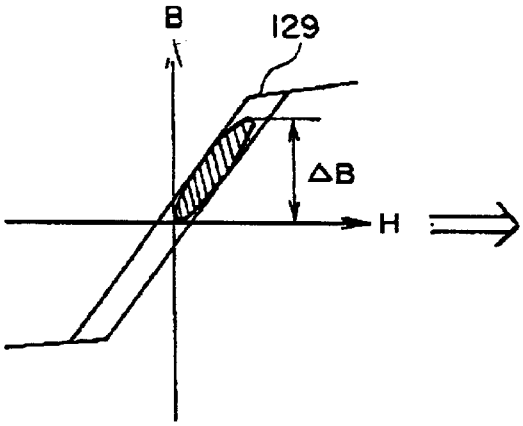
FIG. 31A is a drawing for explaining a working region of a conventional inductor component.
Figure 31B:
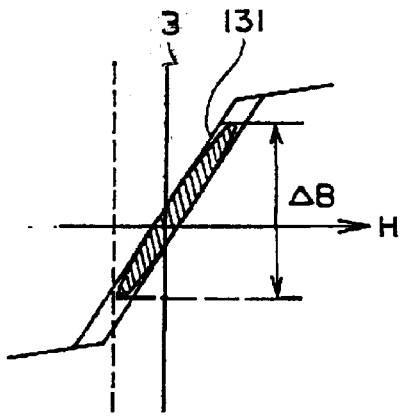
FIG. 31B is a drawing for explaining a working region of the inductor component shown in FIG. 28.

The results of the aforementioned direct current superimposed inductance characteristics are generally equivalent to enlargement of working magnetic flux density (ΔB) of the core constituting the magnetic core, and this is supplementally described below with reference to FIGS. 31A and 31B. In FIG. 31A, 129 indicates a working range of the core relative to a conventional inductor component, and 131 in FIG. 31B indicates a working range of the core relative to the inductor component with the thin plate magnet according to the present invention being applied. Regarding these drawings, 129 and 131 correspond to 125 and 127, respectively, in the aforementioned results of the direct current superimposed inductance characteristics. In general, inductor components are represented by the following theoretical equation (1).

$$\Delta B=(E\cdot \mathrm{ton})/(N\cdot Ae) \quad (1)$$

wherein E denotes applied voltage of inductor component, ton denotes voltage application time, N denotes the number of turns of inductor, and Ae denotes effective cross-sectional area of core constituting magnetic core.

As is clear from this equation (1), an effect of the aforementioned enlargement of the working magnetic flux density (ΔB) is proportionate to the reciprocal of the number of turns N and the reciprocal of the effective cross-sectional area Ae, while the former brings about an effect of reducing the copper loss and miniaturization of the inductor component due to reduction of the number of turns of the inductor component, and the latter contributes to miniaturization of the core constituting the magnetic core and, therefore, contributes to miniaturization of the inductor component by a large degree in combination with the aforementioned miniaturization due to the reduction of the number of turns. Regarding the transformer, since the number of turns of the primary and secondary coils can be reduced, an enormous effect is exhibited.

Furthermore, the output power is represented by the equation (2). As is clear from the equation, the effect of enlarging working magnetic flux density (ΔB) affects an effect of increasing output power.

$$Po=\kappa\cdot(\Delta B)^2\cdot f \quad (2)$$

wherein Po denotes inductor output power, κ denotes proportionality constant, and f denotes driving frequency.

Regarding the reliability of the inductor component, the direct current superimposed inductance characteristic was measured after passing through a reflow furnace (peak temperature of 270° C.) similarly to the above description. As a result, the direct current superimposed inductance characteristic after the reflow was verified to be equivalent to that before the reflow.

EXAMPLE 26

Figure 32:
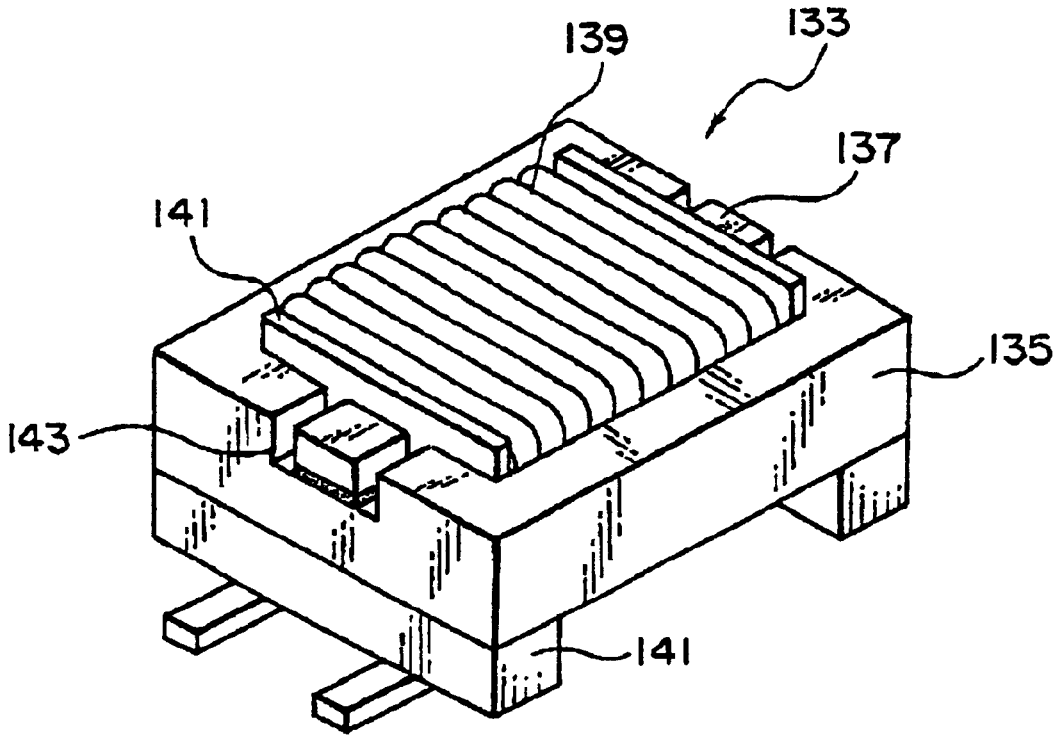
FIG. 32 is a perspective external view of an embodiment of an inductor component including a thin plate magnet according to Example 26 of the present invention.
Figure 33:
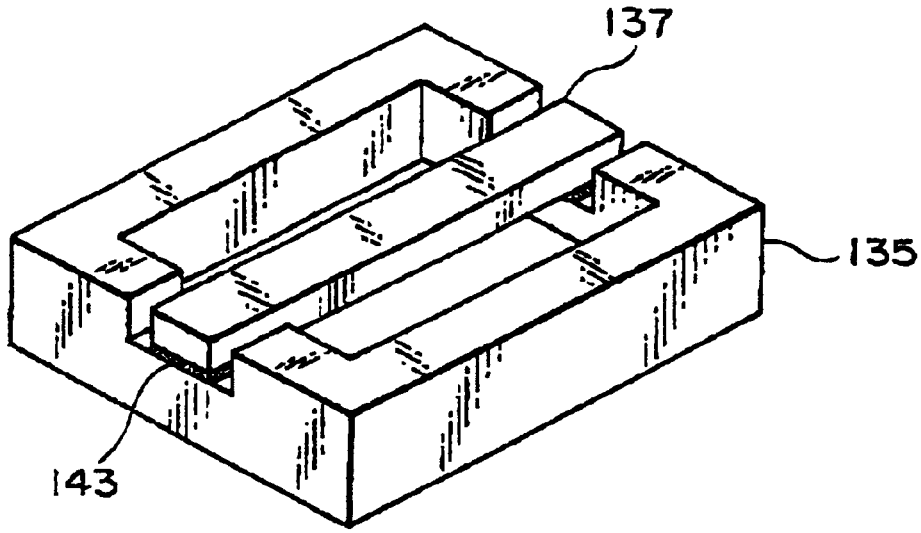
FIG. 33 is a perspective configuration view of a core and a thin plate magnet constituting a magnetic path of the inductor component shown in FIG. 32.

Another inductor component according to the present invention will now be described below with reference to FIGS. 32 and 33. The inductor component according to Example 26 of the present invention is composed of a square type core 135 having rectangular concave portions, an I type core 137, a bobbin 141 with a coil 139 being applied, and thin plate magnets 143. As shown in FIG. 33, the thin plate magnets 143 are arranged in the rectangular concave portions of the square type core 135, that is, at the joint portions of the square type core 135 and the I type core 137.

Herein, the square type core 135 and I type core 137 are made of MnZn ferrite material, and constituting the magnetic core having a shape of the two same rectangles arranged side-by-side and having a magnetic path length of 6.0 cm and an effective cross-sectional area of 0.1 $cm^2$.

The thin plate magnet 143 hard a thickness of 0.25 mm and a cross-sectional area of 0.1 $cm^2$, and direction of the magnetization of the thin plate magnet 143 is specified to be reverse to the direction of the magnetic field made by the coil.

Figure 34:
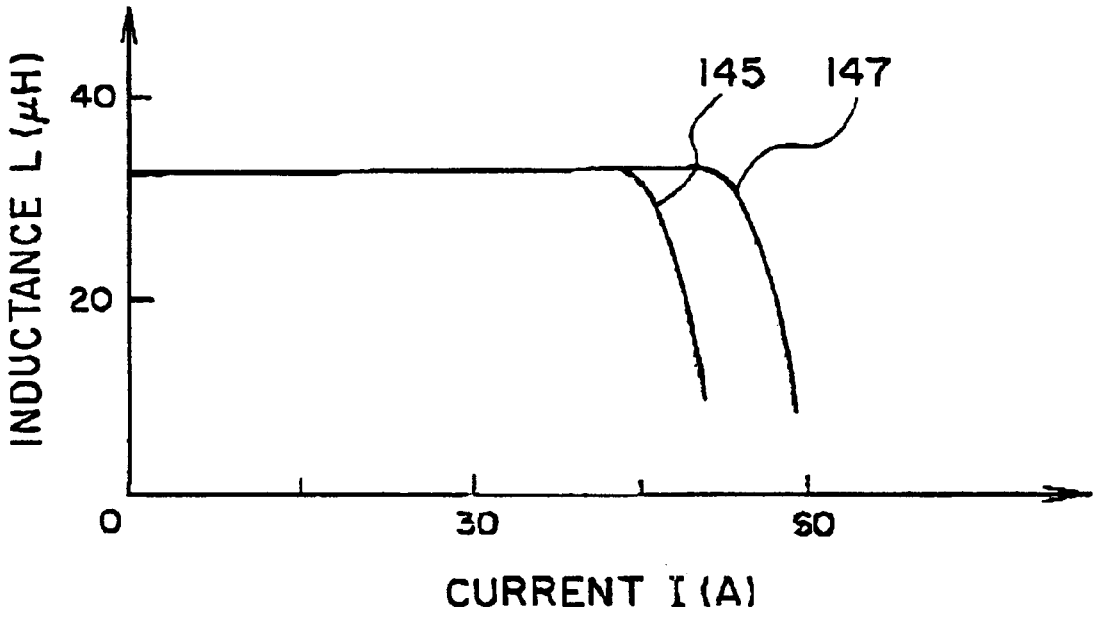
FIG. 34 is a graph showing the direct current superimposed inductance characteristic of the inductor component shown in FIG. 32.

The coil 139 has the number of turns of 18 turns, and the direct current superimposed inductance characteristics were measured regarding the inductor component according to the present invention and, for purposes of comparison, regarding the case where the thin plate magnet was not applied. The results are indicated by 147, the former, and 145, the latter, in FIG. 34.

The direct current superimposed inductance characteristic was measured after passing through a reflow furnace (peak temperature of 270° C.) similarly to the above description. As a result, the direct current superimposed inductance characteristic after the reflow was verified to be equivalent to that before the reflow.

EXAMPLE 27

Figure 35:
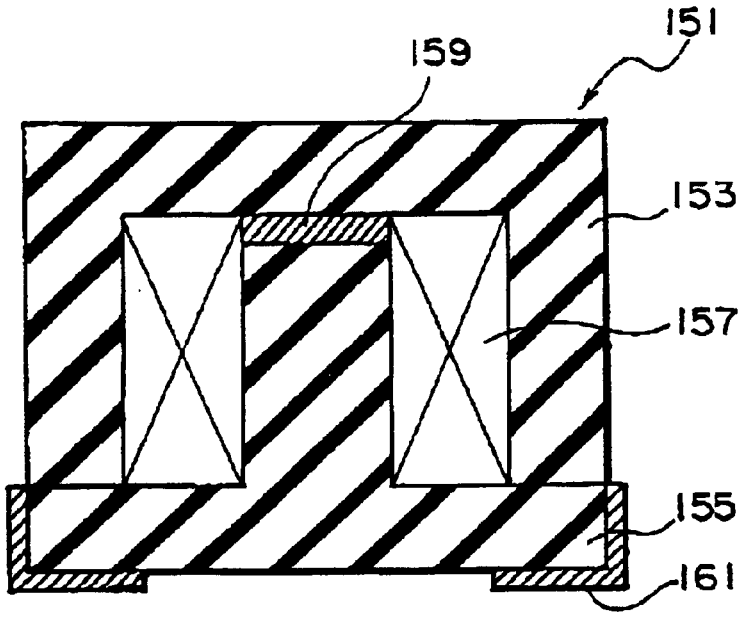
FIG. 35 is a perspective external view of an embodiment of an inductor component including a thin plate magnet according to Example 27 of the present invention.
Figure 36:
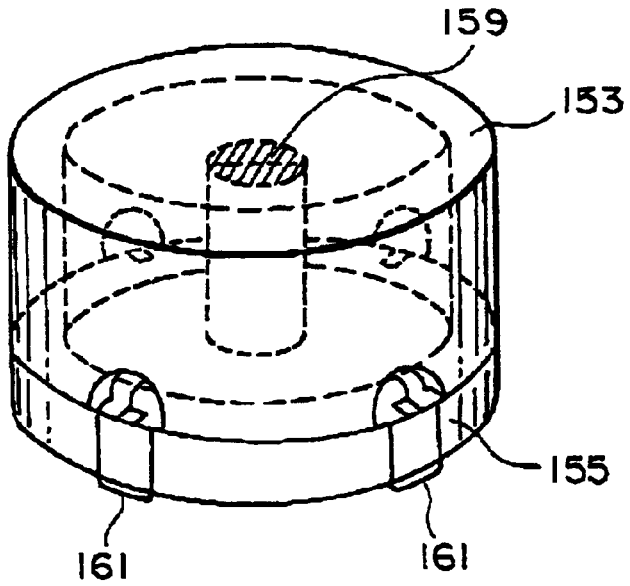
FIG. 36 is a perspective configuration view of a core and a thin plate magnet constituting a magnetic path of the inductor component shown in FIG. 35.

Another inductor component according to the present invention will now be described below with reference to FIGS. 35 and 36. A thin plate magnet according to Example 27 of the present invention is applied to the inductor component. Regarding the configuration of the inductor component, a coil 157 is applied to a convex type core 153, a thin plate magnets 159 is arranged on the top surface of the convex portion of the convex type core 153, and these are covered with a cylindrical cap core 155. The thin plate magnet 159 has the same shape (0.07 mm) with the top surface of the convex portion of the convex type core 153, and has a thickness of 120 μm.

Herein, the aforementioned convex type core 153 and cylindrical cap core 155 are made of NiZn ferrite material, and constituting the magnetic core having a magnetic path length of 1.85 cm and an effective cross-sectional area of 0.07 $cm^2$.

The direction of the magnetization of the thin plate magnet 159 is specified to be reverse to the direction of the magnetic field made by the coil.

Figure 37:
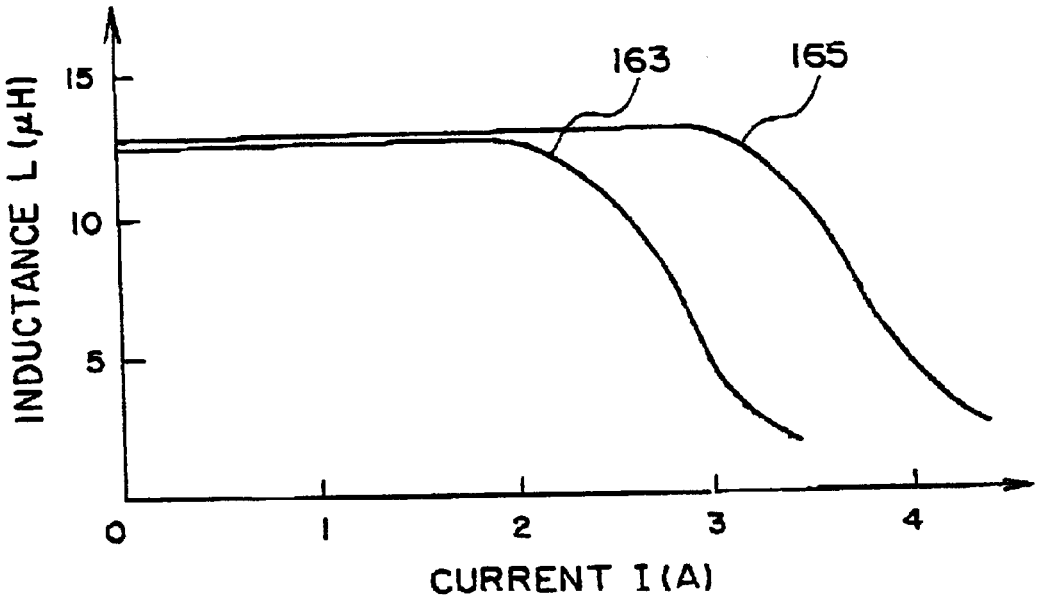
FIG. 37 is a graph showing the direct current superimposed inductance characteristic of the inductor component shown in FIG. 35.

The coil 157 has the number of turns of 15 turns, and the direct current superimposed inductance characteristics were measured regarding the inductor component according to the present invention and, for purposes of comparison, regarding the case where the thin plate magnet was not applied. The results are indicated by 165 (the former) and 163 (the latter) in FIG. 37.

The direct current superimposed inductance characteristic was measured after passing through a reflow furnace (peak temperature of 270° C.) similarly to the above description. As a result, the direct current superimposed inductance characteristic after the reflow was verified to be equivalent to that before the reflow.

What is claimed is:

1. A magnetic core comprising at least one gap in a magnetic path and a permanent magnet inserted in the gap, wherein said magnetic core has an alternating current magnetic permeability at 20 kHz of at least 45 in a magnetic field of 120 Oe under application of direct current and a core loss characteristic of not more than 100 kW/$m^3$ at 20 kHz and a maximum magnetic flux density of 0.1 T.

2. The magnetic core according to claim 1, wherein the magnetic core has an initial permeability of at least 100.

3. The magnetic core according to claim 1, wherein the magnetic core comprises one of Ni—Zn ferrite and Mn—Zn ferrite, and wherein the magnet is a bonded magnet comprising a rare-earth magnet powder and a binder.

4. The magnetic core according to claim 3, wherein the rare-earth magnet powder has an average particle diameter of no more than 10 μm and the binder has a volume % of 5 to 30, and wherein the bonded magnet has a resistivity of at least 1 Ω·cm and an intrinsic coercive force of at least 5 kOe.

5. The magnetic core according to claim 1, wherein the permanent magnet is a bonded magnet comprising a magnet powder dispersed in a resin and has a resistivity of at least 0.1 Ω·cm, and wherein the magnet powder has an intrinsic coercive force of at least 5 kOe, a Curie point Tc of at least 300° C., and an average particle diameter of not more than 150 μm.

6. The magnetic core according to claim 5, wherein the magnet powder has an average particle diameter of 2.0 to 50 μm.

7. The magnetic core according to claim 6, wherein the resin content is at least 10 vol %.

8. The magnetic core according to claim 6, wherein the magnet powder is a rare-earth magnet powder.

9. The magnetic core according to claim 6, wherein a molding compressibility of the magnetic core is at least 20%.

10. The magnetic core according to claim 6, wherein the rare-earth magnet powder comprises one of a silane coupling agent and a titanium coupling agent.

11. The magnetic core according to claim 6, wherein the bonded magnet has anisotropy due to magnetic field orientation during production thereof.

12. The magnetic core according to claim 6, wherein the magnet powder is coated with a surfactant.

13. The magnetic core according to claim 6, wherein the permanent magnet has a center line average roughness of not more than 10 μm.

14. The magnetic core according to claim 6, wherein the permanent magnet has a resistivity of at least 1 Ω·cm.

15. The magnetic core according to claim 14, wherein the permanent magnet is produced by die molding.

16. The magnetic core according to claim 15, wherein the permanent magnet is produced by hot press.

17. The magnetic core according to claim 6, wherein the permanent magnet has a total thickness of not more than 500 μm.

18. The magnetic core according to claim 17, wherein the permanent magnet is produced from a mixed coating of a resin and magnet powder by a film making method.

19. The magnetic core according to claim 17, wherein the permanent magnet has a surface glossiness of at least 25%.

20. The magnetic core according to claim 6, wherein the resin is at least one selected from the group consisting of polypropylene resins, 6-nylon resins, 12-nylon resins, polyimide resins, polyethylene resins, and epoxy resins.

21. The magnetic core according to claim 6, wherein the surface of the permanent magnet is coated with one of a resin and a heat-resistant coating having a heat resistance temperature of at least 120° C.

22. The magnetic core according to claim 6, wherein the magnet powder is a rare-earth magnet powder selected from the group consisting of SmCo, NdFeB, and SmFeN.

23. The magnetic core according to claim 6, wherein the magnet powder has an intrinsic coercive force of at least 10 kOe, a Curie point of at least 500° C., and an average particle diameter of 2.5 to 50 μm.

24. The magnetic core according to claim 23, wherein the magnet powder is an Sm—Co rare-earth magnet powder.

25. The magnetic core according to claim 23, wherein the SmCo rare-earth magnet powder is an alloy powder represented by $Sm(Co_{bal}Fe_{0.15\ to\ 0.25}Cu_{0.05\ to\ 0.06}Zr_{0.02\ to\ 0.03})_{7.0\ to\ 8.5}$.

26. The magnetic core according to claim 23, wherein the resin content is at least 30 vol %.

27. The magnetic core according to claim 23, wherein the resin is at least one selected from the group consisting of polyimide resins, poly(amide-imide) resins, epoxy resins, poly(phenylene sulfide) resins, silicone resins, polyester resins, aromatic polyamide resins, and liquid crystal polymers.

28. An inductor component comprising the magnetic core according to claim 1, wherein at least one turn of coil is applied to the magnetic core.

* * * * *